US005335056A

United States Patent [19]

Muramatsu

[11] Patent Number: 5,335,056

[45] Date of Patent: Aug. 2, 1994

[54] RECORDING APPARATUS HAVING PLURALITY OF DEVELOPING UNITS

[75] Inventor: Masanori Muramatsu, Tokyo, Japan

[73] Assignee: Canon Kabushiki Kaisha, Tokyo, Japan

[21] Appl. No.: 97,615

[22] Filed: Jul. 27, 1993

Related U.S. Application Data

[63] Continuation of Ser. No. 437,033, Nov. 15, 1989, abandoned.

[30] Foreign Application Priority Data

Nov. 16, 1988 [JP] Japan ..... 63-287563
Aug. 31, 1989 [JP] Japan ..... 1-225390

[51] Int. Cl.[5] ..... G03G 15/01; G03G 15/14

[52] U.S. Cl. ..... 355/327; 355/271; 355/245; 355/326 R

[58] Field of Search ..... 355/326, 327, 271, 272, 355/317, 245; 118/656, 657, 658; 346/160, 108; 358/300

[56] References Cited

U.S. PATENT DOCUMENTS 4,472,047 9/1984 Stoudt ..... 555/326
4,663,257 5/1987 Murasawa et al. ..... 355/272 X
4,664,499 5/1987 Alston ..... 355/272 X
4,712,906 12/1987 Bothner et al. ..... 355/271
4,772,916 9/1988 Mochida ..... 355/327
4,899,196 2/1990 Mahoney ..... 355/271

FOREIGN PATENT DOCUMENTS 0282283 9/1988 European Pat. Off. .
0339309 11/1989 European Pat. Off. .
05564 7/1988 PCT Int'l Appl. .

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A recording apparatus includes a photosensitive drum on which a latent image is to be formed, a movable developing assembly which can be brought into contact with or separated from the photosensitive drum, the movable developing assembly consisting of a plurality of developing units for developing the latent image, a transfer drum having a gripper for winding a plurality of transfer sheets on the transfer drum, a separation pawl, inner and outer separation press rollers, and a separation charger for separating the transfer sheets wound around the transfer drum, and a controller for adjusting a transfer sheet feed timing in accordance with a change time period of the plurality of developing units to be used and a transfer sheet size.

14 Claims, 22 Drawing Sheets

| MOVEMENT POSITION / PRESENT POSITION | M | C | Y | K | DVHP |
|---|---|---|---|---|---|
| M | | $T_{MC}$ | $T_{MY}$ | $T_{MK}$ | $T_{MH}$ |
| C | $T_{CM}$ | | $T_{CY}$ | $T_{CK}$ | $T_{CH}$ |
| Y | $T_{YM}$ | $T_{YC}$ | | $T_{YK}$ | $T_{YH}$ |
| K | $T_{KM}$ | $T_{KC}$ | $T_{KY}$ | | $T_{KH}$ |
| DVHP | $T_{HM}$ | $T_{HC}$ | $T_{HY}$ | $T_{HK}$ | |

UNIT TIME

| COLOR MODE \ USED DVELOPING UNIT | M | C | Y | K |
|---|---|---|---|---|
| M | O | X | X | X |
| C | X | O | X | X |
| Y | X | X | O | X |
| K | X | X | X | O |
| R | O | X | O | X |
| G | X | O | O | X |
| B | O | O | X | X |
| 3 COLORS | O | O | O | X |
| 4 COLORS | O | O | O | O |

O: DEVELOPING UNIT IS USED
X: DEVELOPING UNIT IS NOT USED

FIG. 18

RECORDING APPARATUS HAVING PLURALITY OF DEVELOPING UNITS

This application is a continuation of appliction Ser. No. 07/437,033 filed Nov. 15, 1989, now abandoned.

BACKGROUND OF THE INVENTION

1. Field of the Invention

The present invention relates to a recording apparatus for forming an image on a transfer medium held on a transfer medium holding member by using a plurality of developing units.

2. Related Background Art

FIG. 19 is a cross-sectional view illustrating developing/transfer arrangement in a conventional color copying machine, and more particularly, showing a structure in which developing units are arranged around a drum.

The color copying machine includes a paper pickup roller 61 for picking up each transfer sheet 63, register rollers 62 for matching paper feeding with the image formation process and causing the transfer sheet 63 to wind around a gripper (not shown) as part of a transfer drum 64, developing units 65 to 68 arranged around a photosensitive drum 72 to sequentially develop color developing agents ( i. e. , magenta, cyan, yellow, and black), and a charger 69 for uniformly charging the photosensitive drum 72.

The color copying machine also includes a transfer charger 70 for transferring a toner image developed on the photosensitive drum 72 to the transfer sheet 63, a cleaner unit 71 for recovering residual toner particles from the photosensitive drum 72, a fixing roller 73 for fixing the toner image on the transfer sheet 63 by means of heat and pressure.

A conventional color copying machine in which the developing units are arranged around the photosensitive drum includes the transfer drum 64 obtained by winding a high-resistance film (transfer film) on a drum frame, the photosensitive drum 72, and the plurality of developing units 65 to 68 arranged around the photosensitive drum 72 so as to be selectively brought into contact therewith. The transfer sheet 63 fed by a paper feed mechanism is wound around the transfer drum 64 by the gripper arranged at part of the transfer drum 64. An image is exposed on the photosensitive drum 72. One of the plurality of developing units is brought into contact with the photosensitive drum 72 to perform the first developing cycle, and an image of the first color is transferred to the sheet at a transfer position. This operation is repeated a plurality of times to transfer toners of different colors onto the transfer sheet 63. The transfer sheet 63 is then separated from the transfer drum 64 by a separating means. The multicolor toner image is fixed by the fixing roller 73, thereby obtaining a multicolor image output.

In the conventional color copying machine, since the plurality of developing units 65 to 68 are arranged around the photosensitive drum 72 although it is difficult to obtain the photosensitive drum 72 having a uniform photosensitive film, the size of the photosensitive body, i.e., the photosensitive drum 72 is inevitably increased, resulting in high cost.

Since the size of the apparatus is increased and developing positions of the respective colors are different from each other, it is difficult to set optimal developing and transfer conditions. That is, a time period during which an image (an arrow in FIG. 19) exposed on the photosensitive drum 72 uniformly charged with the charger 69 reaches the developing unit 65 is different from time periods during which the remaining color images reach the corresponding developing units 66 to 68, and potentials in the developing timings of the respective color toners are different from each other due to dark attenuation. As a result, it is difficult to set optimal developing conditions.

In addition, since a transfer medium such as the transfer sheet 63 is wound around the transfer drum by using the gripper, only one transfer sheet 63 located at the gripper is wound around the transfer drum 64 although the transfer drum 64 has an area capable of receiving two transfer sheets 63, thus posing various problems such as a failure of a high-speed operation and a low throughput.

SUMMARY OF THE INVENTION

It is an object of the present invention to provide a recording apparatus free from the drawbacks described above.

It is another object of the present invention to provide a recording apparatus wherein developing units which store different color developing agents are reciprocated with respect to a photosensitive drum, and a plurality of transfer media can be simultaneously wound around a transfer drum, thereby greatly reducing the size of the recording apparatus and capable of outputting color images in a high throughput.

It is still another object of the present invention to provide a recording apparatus capable of preventing retransfer of a toner held by a transfer medium to a photosensitive drum and obtaining a high throughput without complicating the arrangement of the apparatus and its control sequence.

The above and other objects, features, and advantages of the present invention will be apparent from the detailed description and the appended claims in conjunction with the accompanying drawings.

BRIEF DESCRIPTION OF THE DRAWINGS

FIG. 18 is a view showing a correspondence between color modes land use of developing units; and FIG. 1 is a view for explaining a developing and transfer arrangement in a conventional color copying machine.

Figure 1:
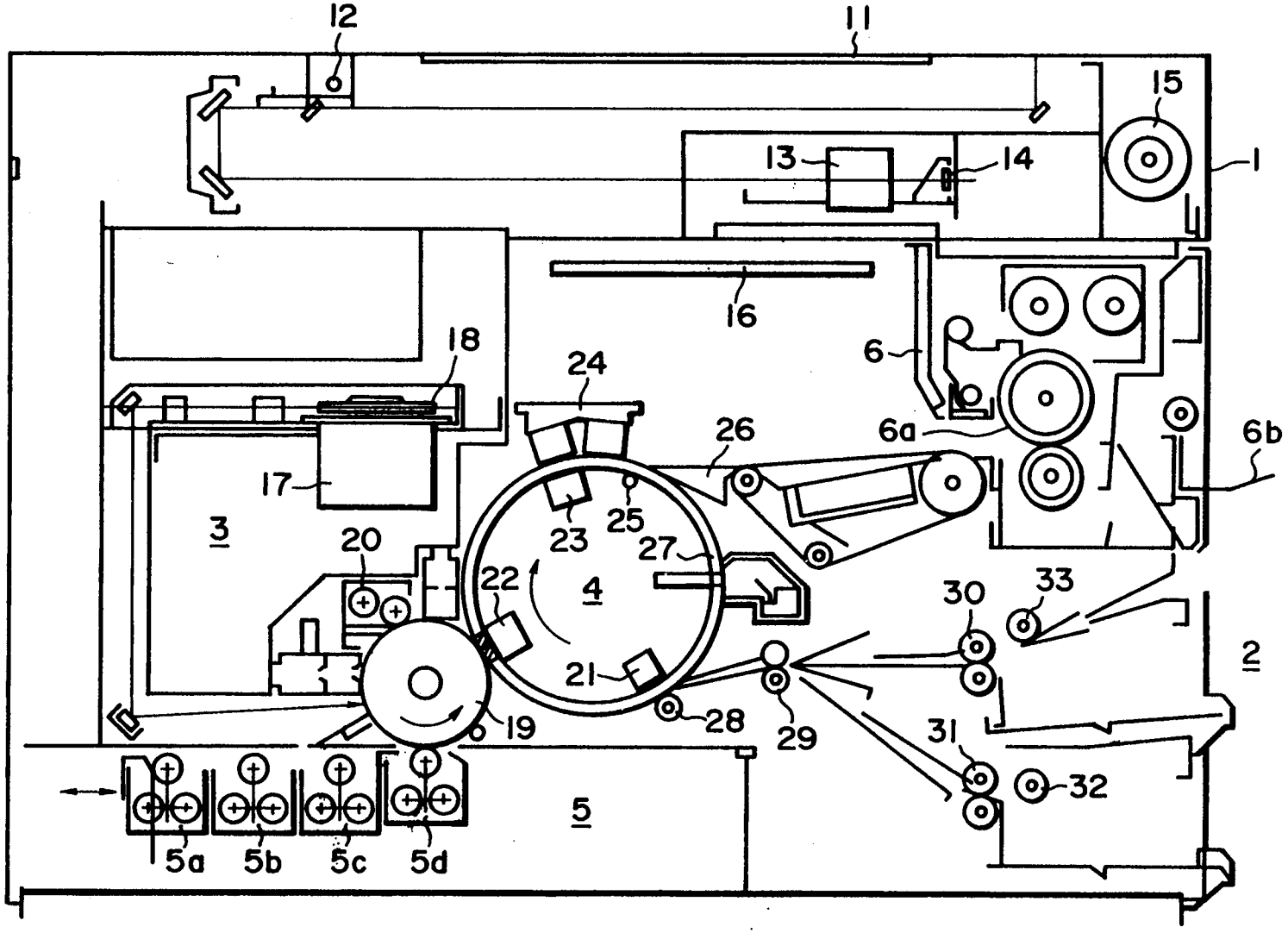
FIG. 1 is a cross-sectional view illustrating an arrangement of a color copying apparatus according to an embodiment of the present invention.

DETAILED DESCRIPTION OF THE PREFERRED EMBODIMENTS:

FIG. 1 is a cross-sectional view illustrating an arrangement of a color coping machine according to an embodiment of the present invention. A reader unit 1 includes an original table (platen glass) 11, an original illumination lamp 12, a focusing lens 13, an image pickup element (constituted by a charge-coupled element such as a CCD) 14, and an optical motor 15. The reader unit 1 reads an original image upon scanning by an original scanning unit moved together with the original illumination lamp 12 at a constant speed determined in accordance with a preset magnification and the like. An operation section (to be described later) is arranged around the original table (platen glass) 11. Switches for setting various modes associated with copying sequences, a display, and indicators are arranged in the operation section.

An original feed unit 2 includes paper feed rollers 30 and 31, and pickup rollers 32 and 33 and feeds a transfer sheet 63 or the like in accordance with a drive command from a controller 16.

An image forming unit 3 includes a scanner motor 17, a polygonal mirror 18, a photosensitive drum 19, and a cleaner unit 20. The image forming unit 3 focuses a laser beam from a laser source onto the photosensitive drum 19 on the basis of an image signal obtained by causing the controller 16 to process an output from the image pickup element 14, thereby forming a latent image on the photosensitive drum 19.

An image transfer unit 4 includes an absorption charger 21, a transfer charger 22, a separation charger 23, a high-voltage unit 24, an inner separation press roller 25, a separation pawl 26, a transfer drum 27, an absorption roller 28, and register rollers 29. The image transfer unit 4 forms a predetermined amount of loop of the transfer sheet at a position of the register rollers 29 by means of the paper feed rollers 30 or 31 and causes the register rollers 29 to feed the transfer sheet 63 at a timing obtained when feeding is synchronized with the leading end of the image on the photosensitive drum 19. The transfer sheet 63 fed upon driving by the register rollers 29 is electrostatically attracted or absorbed on the transfer drum 27 by means of the absorption charger 21 and the absorption roller 28 serving as a counter electrode. The transfer charger 22 transfers each color developing agent developed on the photosensitive drum 19 to the transfer sheet 63. The separation charger 23 serving as a discharging charger discharges the transfer sheet 63 to attenuate an attraction or absorption force between the sheet and the transfer drum 27. In this case, in order to prevent slight movement of the developing agent due to a separation discharge, a high voltage is applied from the high-voltage unit 24 to the transfer sheet 63.

A developing assembly 5 consists of developing units 5*a* to 5*d* and can be reciprocated in directions indicated by a double-headed arrow by a motor (to be described later). The developing units 5*a* to 5*d* can be selectively lifted by a lifter or lift-up mechanism (not shown) so that the corresponding developing sleeve comes close to or is moved away from a predetermined position of the photosensitive drum 19 so as to bring the selected developing unit into contact with the photosensitive drum 19. For example, black, yellow, cyan, and magenta developing agents are stored in the developing agents 5*a* to 5*d*, respectively.

In a fixing unit 6, the toners are fixed on the transfer sheet 63 by a fixing roller 6*a* and a press roller, thereby exhausting the sheet 63 onto an exhaust tray 6*b*.

The controller 16 also serves as an adjusting means. A driving means for reciprocating the developing units 5*a* to 5*d* sequentially moves the developing units 5*a* to 5*d* to cause the selected developing unit to come close to or to be moved away from the predetermined position of the photosensitive drum 19, thereby visualizing each latent image formed on the photosensitive drum 19 into the corresponding toner image. An image developed on the photosensitive drum 19 is transferred to the transfer sheet 63 wound around the transfer drum 27 by a winding means (constituted by the absorption charger 21 and the absorption roller 28). At this time, the controller 16 adjusts paper feed timings of the transfer sheets 63 sequentially absorbed on the transfer drum 27 in accordance with a selected transfer sheet size and a positional relationship between the photosensitive drum 19 and the developing units 5*a* to 5*d* and absorbs a plurality of transfer sheets 63 on the transfer drum 27 at predetermined intervals. At the same time, the controller 16 determines timings for absorbing the subsequent transfer sheets 63 on the transfer drum 27.

The absorption of the transfer sheet 63 on the transfer drum 27 and the separation of the transfer sheet therefrom will be described below.

The absorption charger 21 is a corona charger having characteristics opposite to those of the toner. Since the absorption roller 28 serves as a conductive roller, the absorption roller 28 is grounded and serves as a counter electrode of the absorption charger 21. At the same time, the absorption roller 28 injects charges into the transfer sheet, thereby absorbing or attracting the transfer sheet 63.

When the transfer sheet 63 absorbed on the transfer film and opposite to the transfer charger 22 is rotated, charges opposite to the polarity of the toner are applied to the back surface of the transfer film, and a transfer operation of the first color is performed. Thereafter, the developing units 5*a* to 5*d* are sequentially moved. When a developing and transfer operation of the fourth color is completed, the absorption or attraction force of the transfer sheet 63 on the transfer film is weakened, an AC corona discharge is supplied from the pair of separation chargers 23 to the transfer film interposed therebetween, thereby discharging the transfer sheet. The separation press roller 25 located inside the transfer film to separate the transfer sheet from the transfer film is brought into contact with the transfer film. At the same time, an outer separation press roller 41 shown in FIG. 2 is brought into contact with the transfer film.

The curvature of the transfer film is locally changed, and the separation pawl 26 is inserted between the transfer sheet 63 and the transfer film, thereby separating the transfer sheet 63 front the transfer film. At this time, an AC corona charge is applied from the high-voltage unit 24 to prevent image disturbance by the separation discharge.

Figure 2:
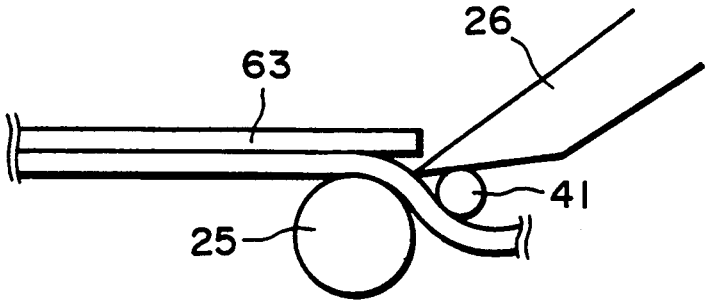
FIG. 2 is a cross-sectional view showing a main part for explaining separation of a transfer sheet by a separation pawl shown in FIG. 1.

FIG. 2 is a cross-sectional view showing a main part for explaining separation of the transfer sheet 63 by the separation pawl 26 shown in FIG. 1. The same reference numerals as in FIG. 1 denote the same parts in FIG. 2.

The outer separation press roller 41 is interlocked with the inner separation press roller 25 to change the curvature of the transfer film to separate the transfer sheet 63 from the transfer film.

Figure 3:
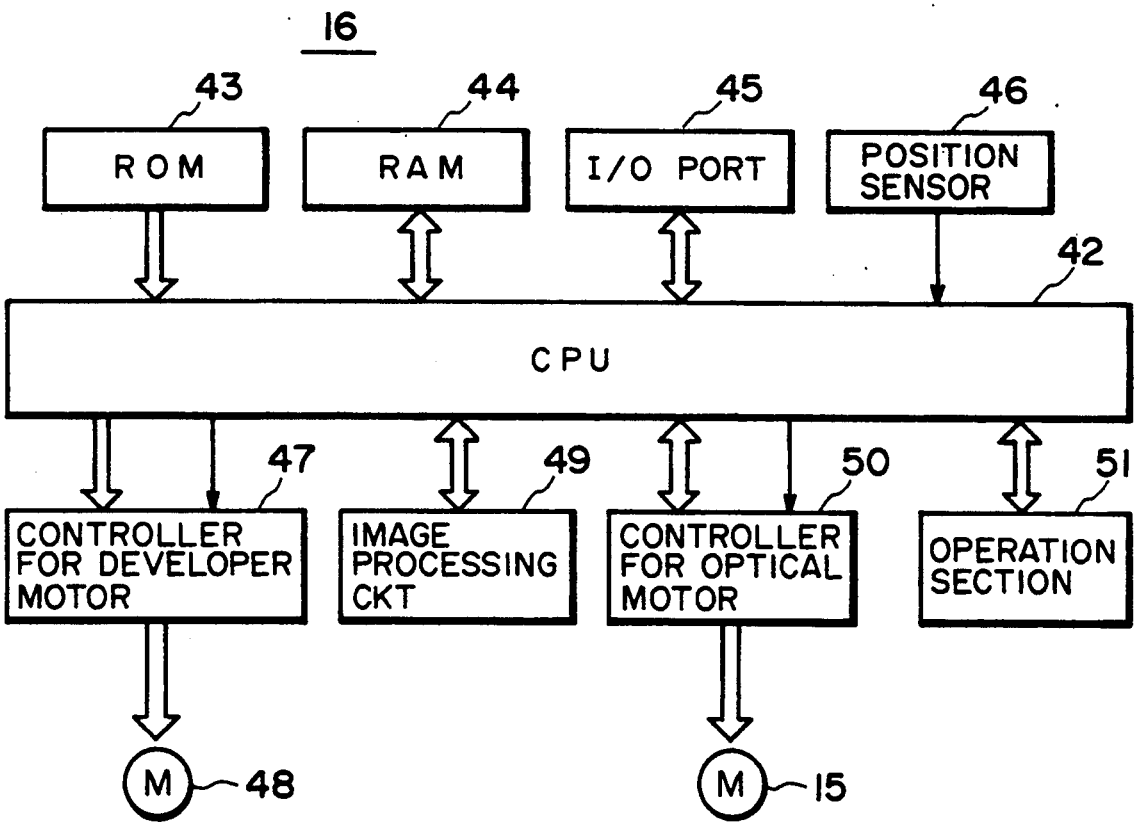
FIG. 3 s a block diagram illustrating an arrangement of a controller shown in FIG. 1.

FIG. 3 is a block diagram for explaining an arrangement of the controller 16 shown in FIG. 1. The controller 16 includes a CPU 42 which controls the overall operation of a copying sequence in accordance with a control program stored in a ROM 43. A RAM 44 serves as a work memory of the CPU 42 and stores various flag data input from the operation section 51. An I/O port 45 receives image data output from the image pickup element 14 shown in FIG. 1 and outputs a sync control signal necessary for image reading.

A position sensor (ITOP sensor) 46 is connected to the CPU 42 to detect a predetermined position (i.e., image leading end positions A and B) of the transfer drum 27 and outputs an image leading end signal ITOP determining transfer timings to the CPU 42.

A controller 47 for developer motor is connected to the CPU 42 to drive a motor 48 to move a developing carrier (not shown) for carrying the developing units 5*a* to 5*d* (FIG. 1) thereon in a direction indicated by an arrow so as to locate the carrier in position at high speed. For example, when four-color image formation is to be performed and a plurality of transfer sheets 62 (a maximum of two sheets in this embodiment) are absorbed on the transfer drum 27, the CPU 42 determines feed and absorption timings such that the next transfer sheet 63 is fed with a delay corresponding to a half rotation of the transfer drum 27. An image processing circuit 49 is connected to the CPU 42 to perform various color separation image processing operations of image data read and input through the I/O port 45 and generates a video signal for modulating a laser source. A controller 50 for optical motor controls to drive the optical motor 15 for reciprocating the original scanning unit. The operation section 51 is also connected to the CPU 42.

An image processing operation in the copying machine shown in FIG. 1 will be described below.

The transfer sheet 63 picked up by the pickup roller 32 or 33 is fed to the register rollers 29 through the.paper feed rollers 30 or 31. Paper ramp is eliminated and a period of predetermined amount of loop of the sheet is formed. The transfer sheet 63 waits for a time at which the transfer sheet 63 is wound around the transfer drum 27. The register rollers 29 are rotated to cause the absorption charger 21 and the absorption roller 28 serving as its counter electrode to absorb the transfer sheet 63 onto the transfer drum 27. An optical system (original scanning unit) is almost simultaneously started, and the image read by the image pickup element 14 is fetched to the image processing circuit 49 through the I/O port 45 shown in FIG. 3.

The image is color-separated and subjected to various color correction operations (e.g., gamma correction) by the image processing circuit 49. The image is converted into a laser beam, and the laser beam is deflected and scanned by the polygonal mirror 18, thereby exposing the photosensitive drum 19 uniformly charged by the charger and hence forming a latent image.

The developer carrier having the magenta toner developing unit 5*d*, the cyan toner developing unit 5*c*, the yellow toner developing unit 5*b*, and the black toner developing unit 5*a* thereon is translated to develop the latent image at predetermined timings.

A toner image formed on the photosensitive drum 19 is transferred to the transfer sheet 63 by the transfer charger 22. A series of operations described above are repeated arequired number of times, and the attraction force is attenuated by the separation charger 23. The inner and outer separation press rollers 25 and 41 (FIG. 2) are brought into contact with the transfer film while a high voltage is kept applied from the high-voltage unit 24 to the transfer film. The separation pawl 26 is inserted into a transfer sheet portion separated from the transfer film and separates the transfer sheet from the transfer drum. The toner image is then fixed by the fixing roller 6*a*, and the transfer sheet having the fixed image is exhausted onto the exhaust tray 6*b*.

The movement operation of the developing units 5*a* to 5*d* shown in FIG. 1 and the timings for feeding the transfer sheets 63 will be described with reference to FIGS. 4 to 8.

Figure 4:
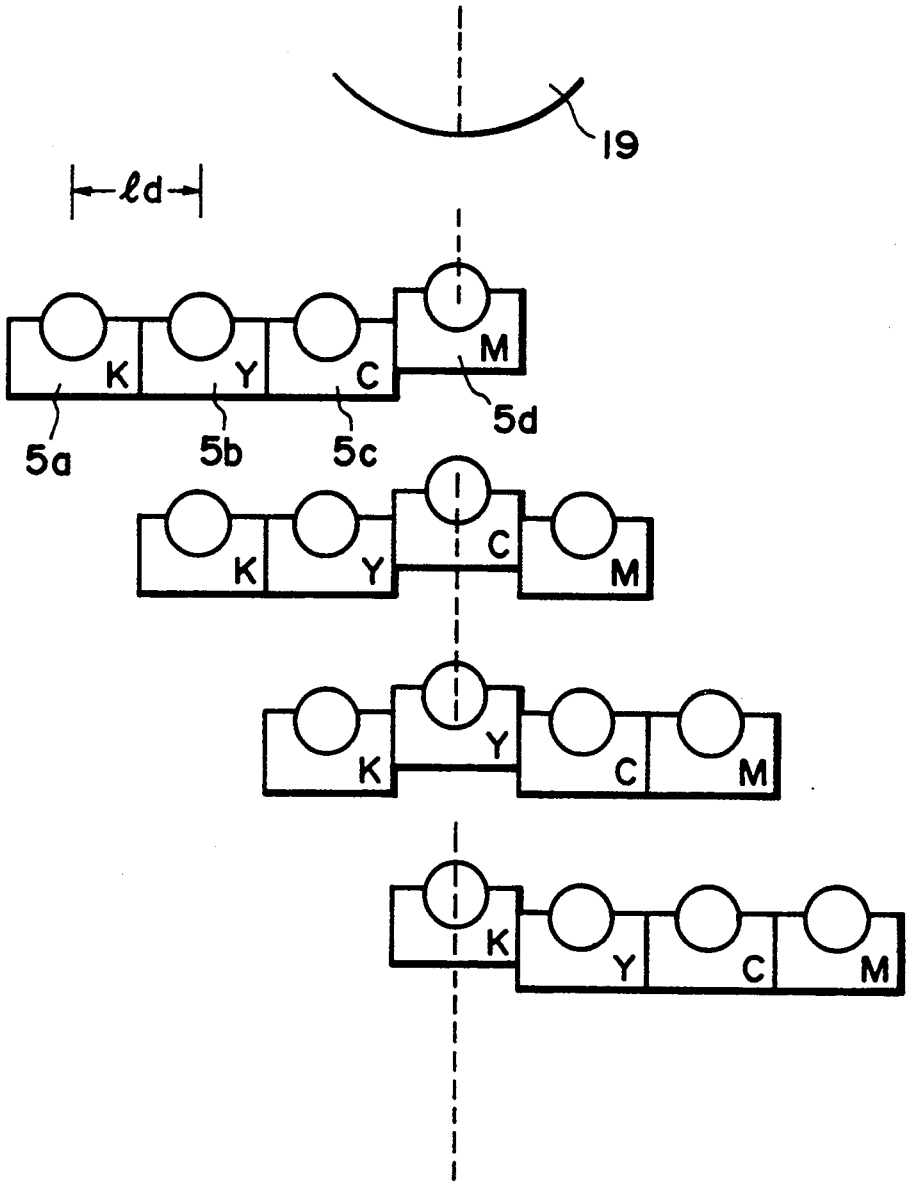
FIG. 4 is a view showing a movement process of developing units shown in FIG. 1.

FIG. 4 is a view showing changes in states of the developing units 5*a* to 5*d* shown in FIG. 1.

As is apparent from FIG. 4, when developing operations of the first to fourth colors are to be performed with respect to the axis of rotation (indicated by a dotted line) of the photosensitive drum 19, the developing units 5*a* to 5*d* are moved a high speed to the position where the axis of each developing sleeve is aligned with the axis of the photosensitive drum 19. The selected developing sleeve is brought into contact with the photosensitive drum 19 by the lift mechanism (not shown), as shown in FIG. 1.

Sleeve intervals of the developing units 5*a* to 5*d* are given as ld each.

Figure 5:
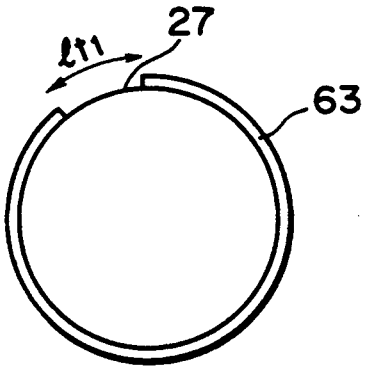
FIGS. 5 and 6 are cross-sectional views for explaining a state in which a transfer sheet is absorbed on a transfer drum shown in FIG. 1.
Figure 6:
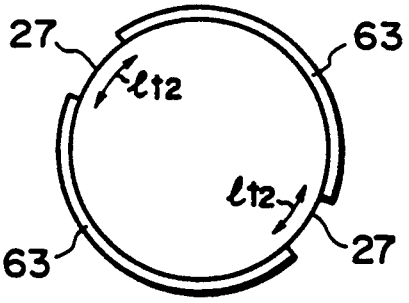

FIGS. 5 and 6 are cross-sectional views showing absorption states of transfer sheets on the transfer drum 27 shown in FIG. 1. FIG. 5 shows a state in which a single sheet having a maximum size is absorbed on the transfer drum, and FIG. 6 shows a state in which a plurality of sheets are absorbed on the transfer drum.

A distance between the leading and trailing ends of the sheet in FIG. 5 is given as lt1, and a distance between the leading and trailing ends of the adjacent sheets is given as lt2. In this case, the diameter of the transfer drum 27 is determined to satisfy inequality $lt1 \geqq 2lt2$.

Figure 7:
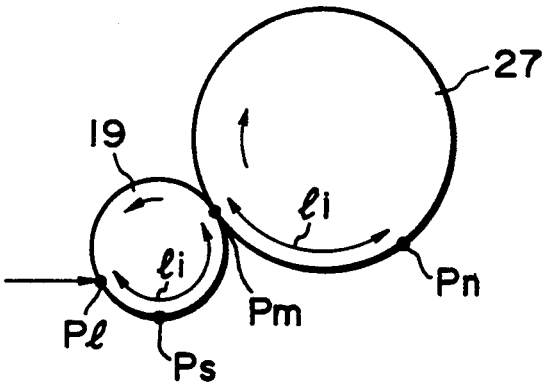
FIG. 7 is a cross-sectional view for explaining an output timing of a transfer timing signal.

FIG. 7 is a cross-sectional view for explaining an output timing of an image leading end signal ITOP.

As can be apparent from FIG. 7, the image leading end signal ITOP is generated at a position Pn spaced apart from a transfer position Pm by a distance li (i.e., a distance between a laser write position Pl and the transfer position Pm), and the transfer sheet 63 is absorbed on the transfer drum 27 such that the leading end of the transfer sheet 63 is aligned with the position Pn. An image developed by the developing sleeve which is brought into contact with the photosensitive drum at a position Ps is transferred to the transfer sheet 63 absorbed on the transfer drum 27 at a predetermined position.

As described above, when a latent image is formed on the photosensitive drum 19 upon generation of the image leading end signal ITOP, a toner image can be transferred to the transfer sheet 63 absorbed from the position Pn.

However, in order to bring one of the developing units 5*a* to 5*d* (FIG. 1) into contact with the photosensitive drum at the position Ps, a time period Tt1 (=lt1/Vt where Vt is the rotational speed of the transfer drum 27) required to move the distance lt1 of the maximum sized sheet (FIG. 5) wound around the transfer drum 27 is controlled to be longer (FIG. 8A) than a time period td required for moving each sleeve of the developing unit by the distance ld.

Idle rotation of the transfer drum 27 is therefore prevented, and development on the latent image by the toner on the transfer drum can be prevented.

In the same manner as in developing unit movement control, the original scanning unit shown in FIG. 1 can be controlled to be back-scanned within a period shorter than the time period Tt1.

Figure 8A:
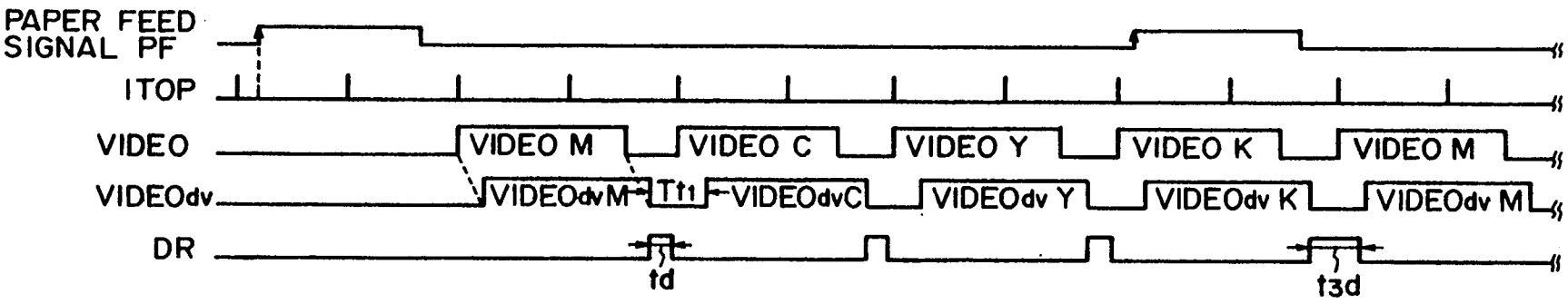
FIGS. 8A and 8B are timing charts for explaining paper feed and developing operations according to the present invention.
Figure 8B:
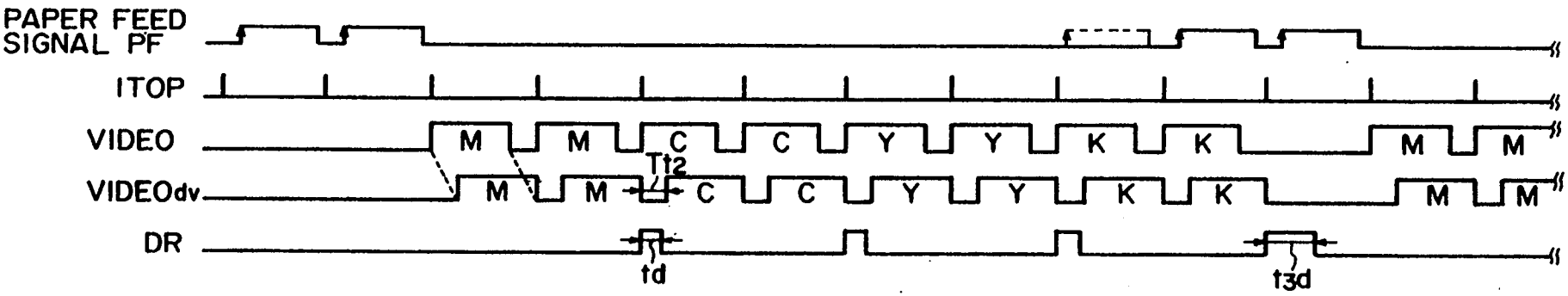

FIGS. 8A and 8B are timing charts for explaining paper feed and developing operations according to the present invention. More specifically, FIG. 8A shows an operation for feeding a single sheet, and FIG. 8B shows an operation for continuously feeding a plurality of sheets.

Referring to FIGS. 8A and 8B, a paper feed signal PF rises when a predetermined period of time has elapsed upon generation of the image leading end signal ITOP and falls upon completion of [ceding of the transfer sheet 63.

Image signals VIDEO and VIDEOdv include a magenta image signal VIDEOdvM, a cyan image signal VIDEOdvC, a yellow image signal VIDEOdvY, and a black image signal VIDEOdvK. The magenta image signal VIDEOdvM is output when the magenta developing unit 5*d* is brought into contact with the photosensitive drum 19.

The cyan image signal VIDEOdvC is output when the cyan developing unit 5*c* is brought into contact with the photosensitive drum 19.

The yellow image signal VIDEOdrY is output when the developing unit 5*b* is brought into contact with the photosensitive drum 19.

The black image signal VIDEOdvK is output when the developing unit 5*a* is brought into contact with the photosensitive drum 19.

A developing unit drive signal DR falls within a time period td shorter than the time period Tt1 required for movement of the developing units 5*d* to 5*a*, as shown in FIG. 8A. When a four-color developing operation is completed, the developing unit 5*d* must be moved toward the axis of the photosensitive drum 19, thus requiring a time period t3d (=td×3). Since the time period t3d is shorter than the time period Tt1, the transfer drum can continuously perform the color copying sequence of the next transfer sheet 63 without idle rotation.

As shown in FIG. 8B, two transfer sheets 63 are sequentially fed by paper feed signals PF output in synchronism with image leading end signals ITOP output from the position sensor 46. Two color developing operations are performed by the developing unit 5*d* upon one rotation of the transfer drum 27. Movement of the next developing unit 5*c* is completed within the time period td shorter than the time period Tt2 required for movement by the distance lt2 of the two adjacent transfer sheets 63. That is, the developing and transfer operations are continuously repeated, as shown in FIGS. 9A to 9D.

Figure 9A:
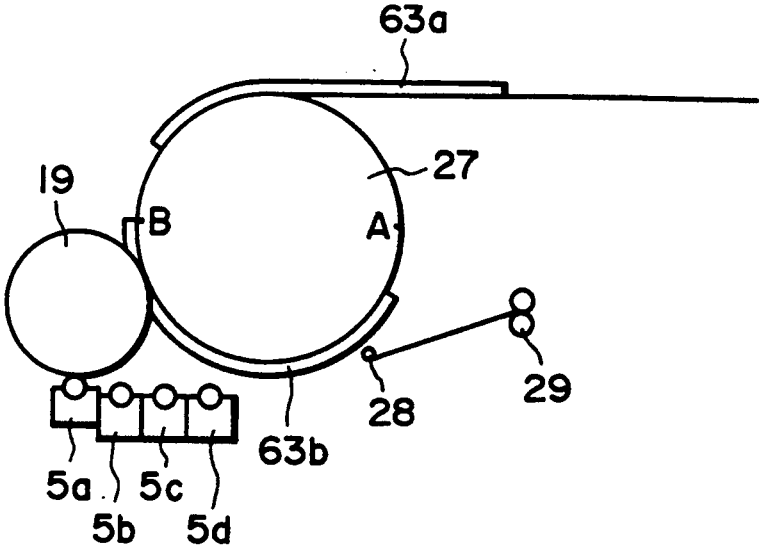
FIGS. 9A to 9D are views showing changes in state for explaining paperfeed timings based on transfer of a plurality of sheets according to the present invention.
Figure 9B:
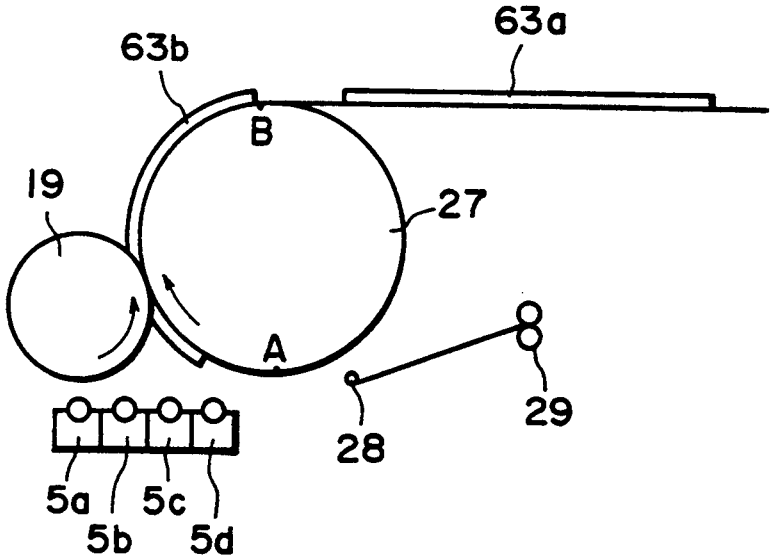

At the time of continuous feeding of the next two sheets, transfer positions A and B (i.e., absorption positions A and B in FIGS. 9A to 9D) are passed from the feed positions (FIG. 9B). Therefore, the two transfer sheets 63 are fed in response to the paper feed signal PF output in synchronism with the image leading end signal ITOP output from the position sensor 46. That is, after the first one of the two continuously fed sheets is separated from the transfer drum 27, the paper feed timing is delayed by a half rotation, thereby preventing a decrease in throughput.

FIGS. 9A to 9D are views showing changes in states for explaining paper feed timings of the two sheets in a four-color (full color) copying mode. The reference numerals as in FIG. 1 denote the same parts in FIGS. 9A to 9D.

Figure 9C:
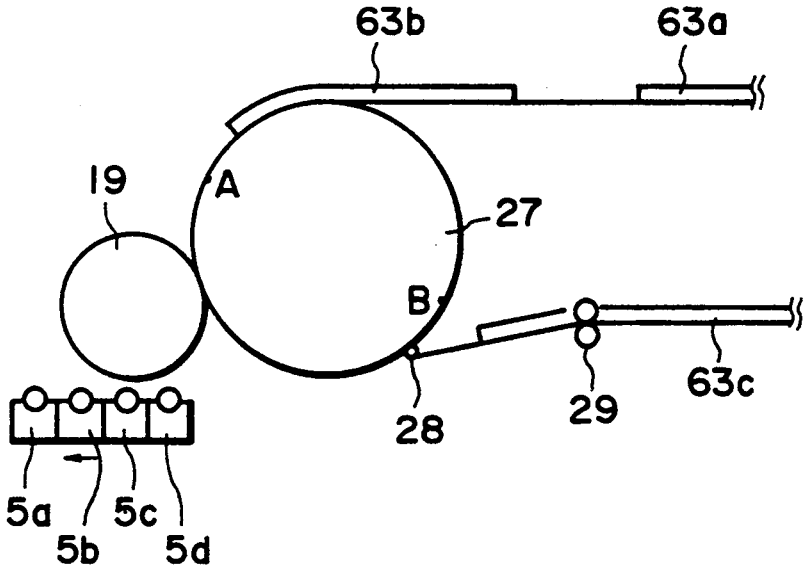
Figure 9D:
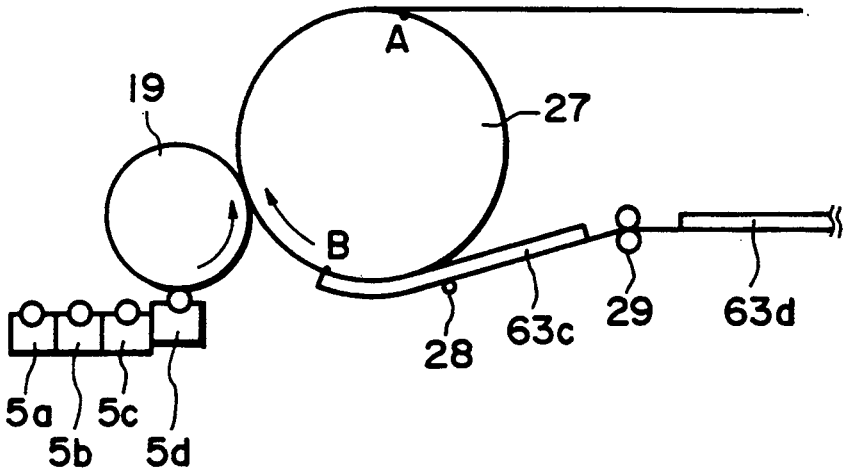
Figure 10A:
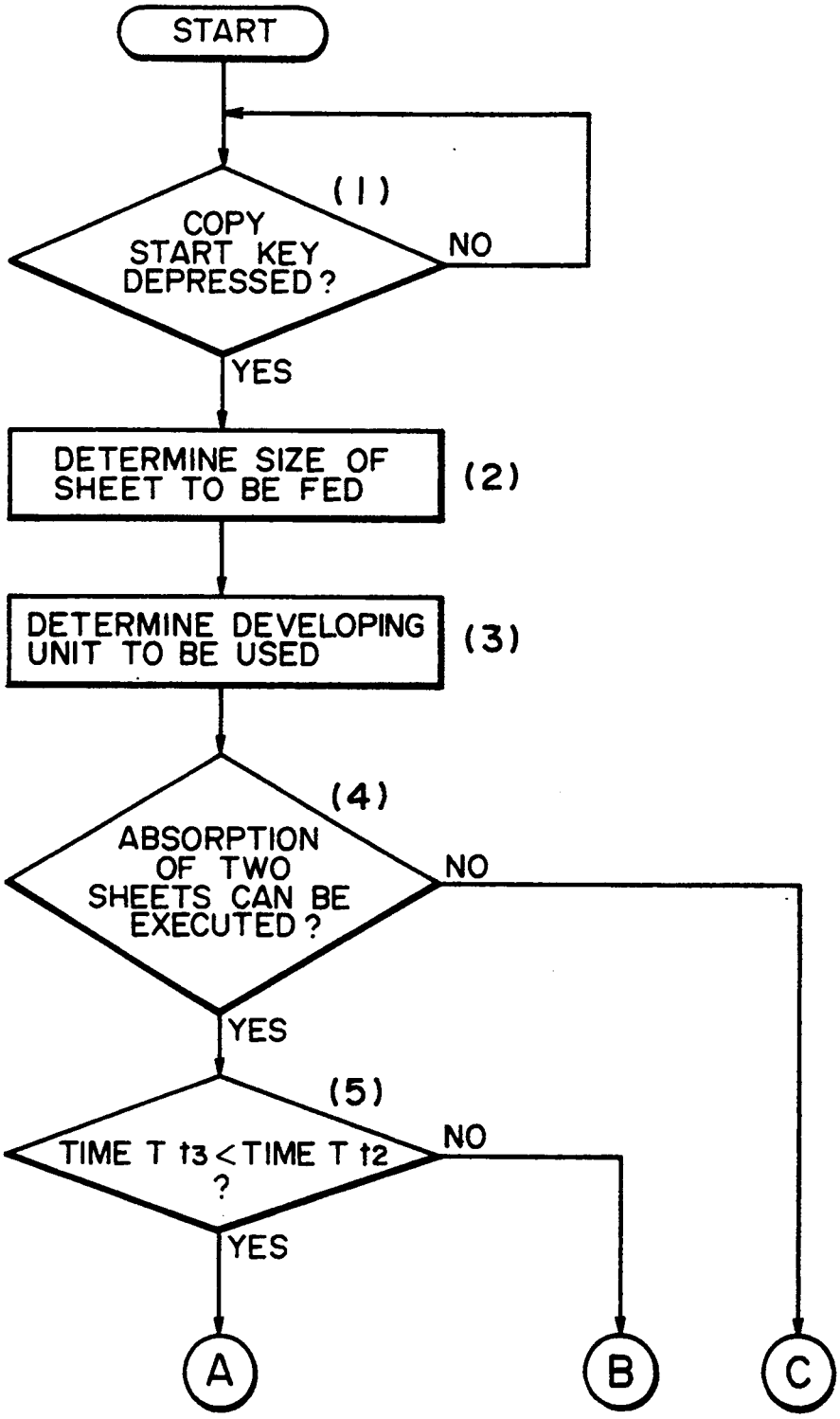
FIGS. 10A to 10D are flow charts for explaining a paper feed and developing sequence according to the present invention.
Figure 10B:
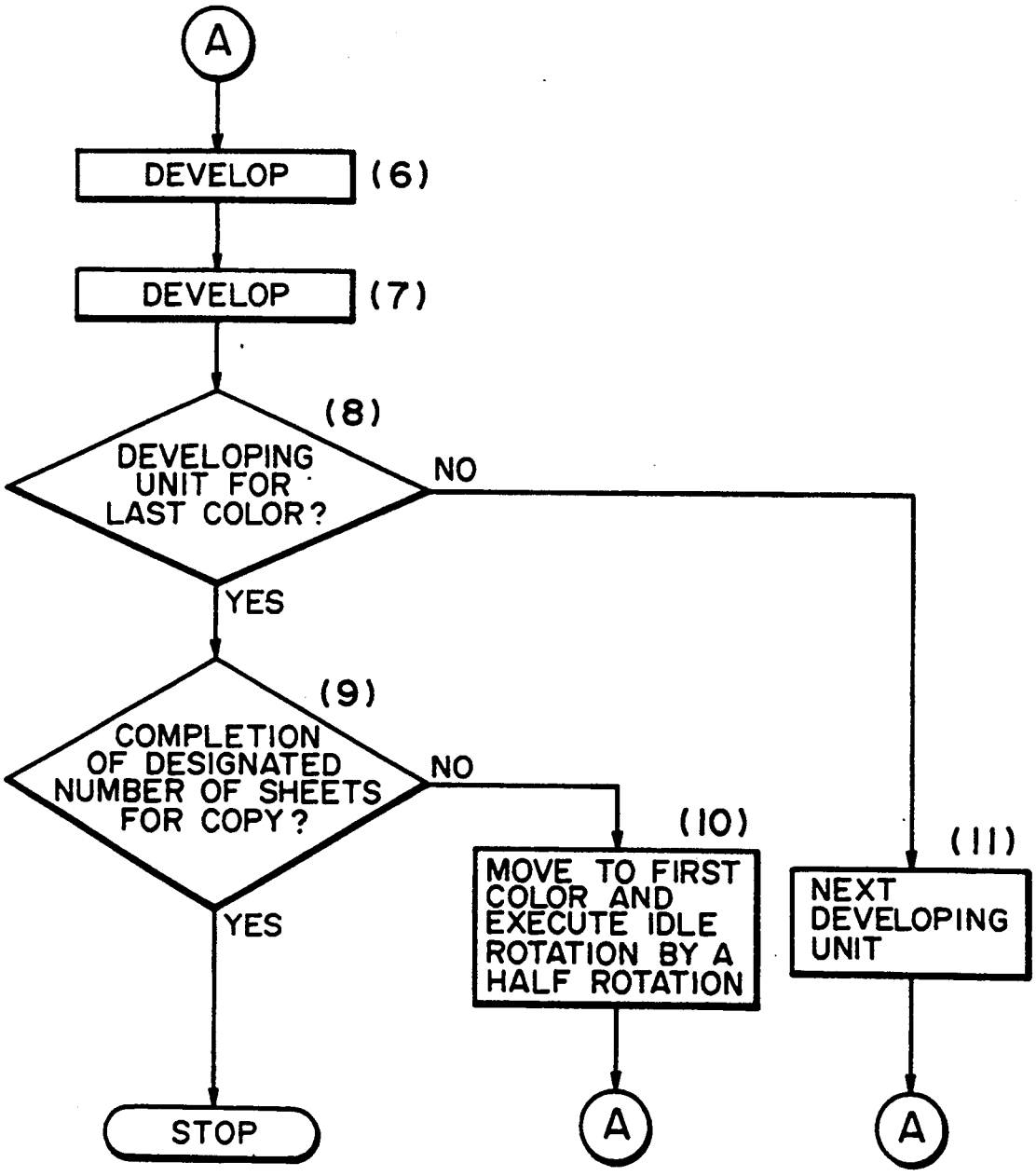
Figure 10C:
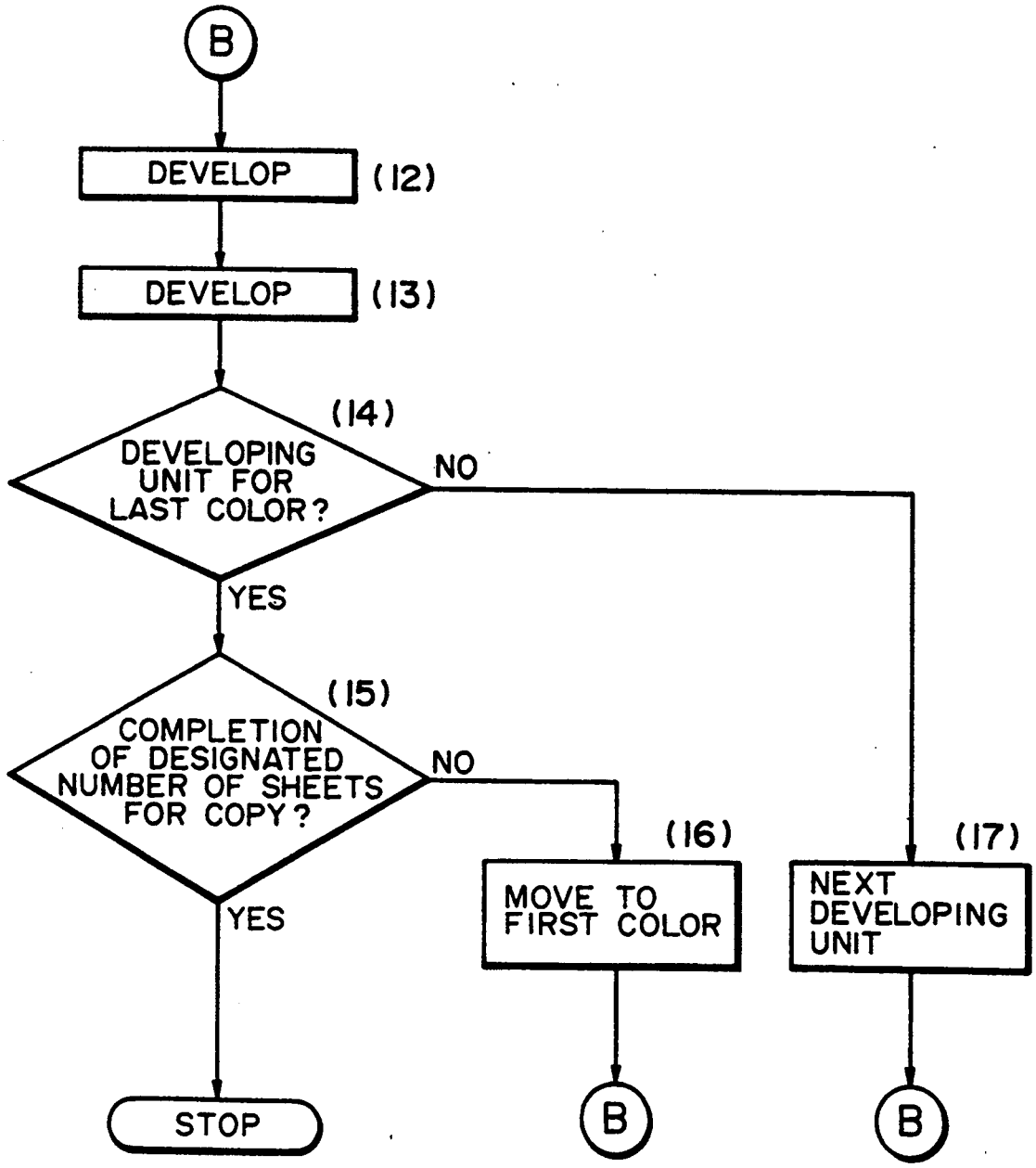
Figure 10D:
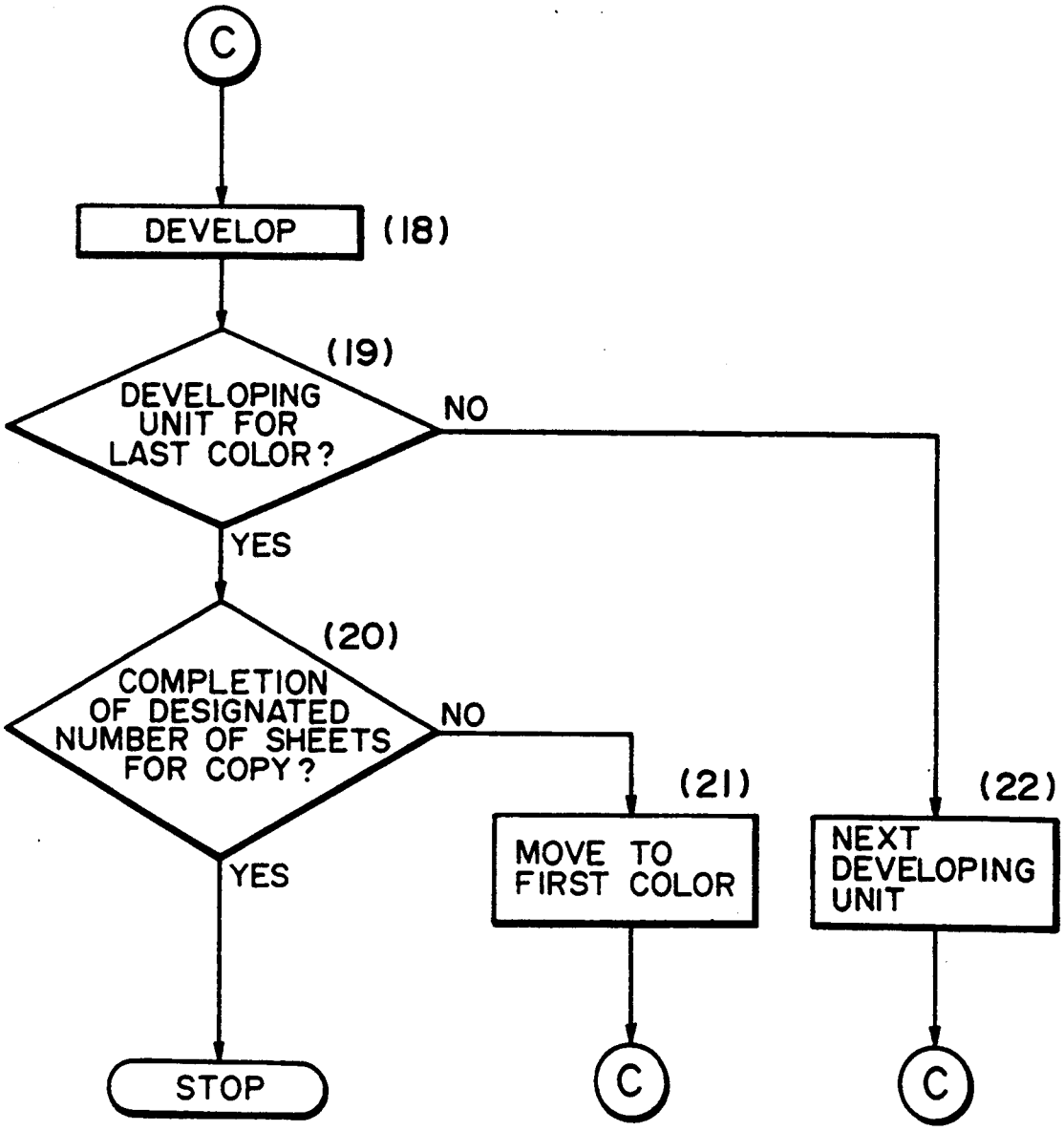

FIG. 9A shows a state in which the last color (black) of the toner image is being transferred to a second transfer sheet 63*b* of the two continuously fed sheets, and FIG. 9B shows a state wherein a lift state of the developing unit 5*a* is released upon completion of development of the last color of the second transfer sheet 63*b*. FIG. 9C shows a state wherein a first transfer sheet 63*c* of the next two continuously fed sheets is being fed. In this case, the developer carrier is moved to allow development of the fist color (magenta). FIG. 9D shows a state wherein the first transfer sheet 63*c* is absorbed, and a second transfer sheet 63*d* is being fed.

Figure 13A:
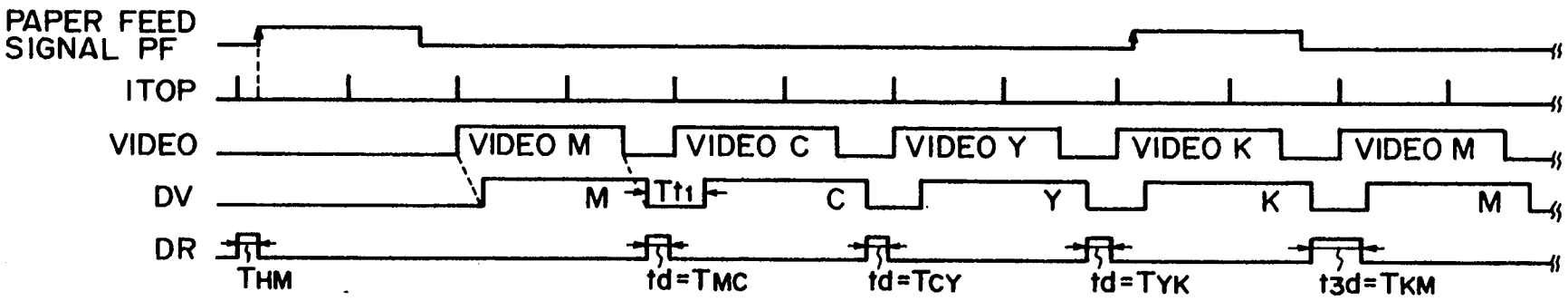
FIGS. 13A and 13B, FIGS. 14A and 14B, FIG. 15, and FIGS. 16A and 16B are timing charts for explaining paper feed and developing operations according to the present invention.

A four-color copying sequence for two-sheet feeding will be described with reference to FIG. 13.

As shown in FIG. 9A, the transfer sheets 63*a* and 63*b* are absorbed at the absorption positions A and B serving as reference positions of the transfer drum 27, respectively. When a toner image developed by the developing unit 5*a* of the last color is transferred from the photosensitive drum 19 to the transfer sheet 63*b*, the transfer sheet 63*a* is separated from the transfer drum 27 earlier than the transfer sheet 63*b*. Thereafter, the lift-up mechanism of the developing unit 5*a* is released at the end of development for the transfer sheet 63*b*, and the developing unit 5*a* can be moved.

The developer carrier having the developing units 5*a* to 5*d* is moved to a predetermined position. In order to move the developing unit 5*d* of the next color to the axial position of the photosensitive drum 19, it takes the time period t3d (td×3). Since this time period is longer than the time period Tt2 required for movement by a distance between the leading and trailing ends of the adjacent two sheets 63, the developing operations of the fed transfer sheet cannot be performed even if the sheet is fed. Therefore, paper feeding cannot be performed such that the next transfer sheet 63*a* is absorbed at the absorption position A of the transfer drum 27 (paper feed signal PF indicated by the dotted line in FIG. 8B). In order to set the absorption position B of the second transfer sheet 63*b* to the absorption position of the next transfer sheet during the previous imaging sequence, feeding of the next transfer sheet 63*c* is delayed by a half rotation of the transfer drum 27. As shown in FIG. 9C, the absorption roller 28 is brought into contact with the transfer drum 27 so as to absorb the fed transfer sheet 63*c*, thus preparing for the above operation.

As shown in FIG. 9D, the transfer sheet 63c is then absorbed at the absorption position B. In this case, the developing and transfer operations of the transfer sheet 63c can be performed since the movement of the developing unit 5d to the axial position of the photosensitive drum 19 is completed at the start of absorption of the transfer sheet 63c and the developing sleeve is in contact with the photosensitive drum 19 by the lift-up mechanism.

In this manner, the subsequent transfer sheet 63c is not absorbed to the absorption position A at which the first transfer sheet 63a was absorbed. Upon idle rotation by a half rotation, the developing units 5a to 5d are moved during this time period, and paper feeding is controlled such that the transfer sheet 63c can be absorbed to the absorption position B where the second transfer sheet 63b was absorbed. The next copying sequence is restatted within a minimum waiting time period, thereby preventing a decrease in throughput.

A paper feeding and developing operation according to the present invention will be described with reference to FIGS. 10A to 10D.

FIGS. 10A to 10D are flow charts for explaining paper feeding and developing processing according to the present invention. Note that reference numerals (1) to (22) denote steps.

A color mode, the number of sheets for copy, a sheet size, and the like are designated at the operation section 51. When a copy start key in the operation section 51 is depressed (1), the CPU 42 determines the sheet size in accordance with a detection signal from the original feed unit 2 and determines a developing unit to be used (3).

The CPU 42 determines whether two transfer sheets 63 are placed on the transfer drum 27 in accordance with the designated sheet size and the designated developing unit or units to be used, i.e-, whether the two transfer sheets 63 are absorbed on the transfer drums 27 in accordance with the above conditions (i.e-, the paper size is ½ or less of the outer circumference of the transfer drum 27, and the time period td required for moving the developing unit to be used next is given such that a movement time period Tt3 required for shifting movement of the developing unit 5a of the last color to movement of the developing unit 5d of the first color is shorter than the sheets interval time period Tt2 required for movement by the distance between the leading and trailing ends of the two adjacent transfer sheets) (4). If NO in step (4), the flow advances to step (18) and the subsequent steps. However, if YES in step (4), the CPU 42 determines whether the time period Tt3 required for shifting movement of the developing unit 5a of the last color to movement of the developing unit 5d of the first color is shorter than the time period Tt2 required for movement by the distance between the leading and trailing ends of the two adjacent transfer sheets (5). If NO in step (5), the flow advances to step (12) and the subsequent steps. However, if YES in step (5), e.g-, if a color mode using only two adjacent developing units is set, the developing unit movement time period is shorter than the sheets interval time period. In this case, the idle rotation for moving the developing unit is not required, and developing operations of the two sheets can be continuously performed by the two selected developing units (6, 7).

The CPU 42 then determines whether the developing unit used is the developing unit 5a of the last color (8). If NO in step (8), the CPU sends a command to the controller 47 for developer motor so as to move the next developing unit to the axial position of the photosensitive drum 19 (11). The flow then returns to step (6), and the next developing operation is started.

However, if YES in step (8), the CPU 42 determines whether the designated number of sheets for copy is obtained (9)- If YES in step (9), processing is ended. However, if NO in step (9), the paper feed timing is delayed by a half rotation. The CPU 42 sends a command to the controller 47 for developer motor so as to shift movement to that of the developing unit 5d of the first color during the above delay time period (10).

If NO in step (5), that is, when the two transfer sheets can be absorbed on the transfer drum 27 and the maximum movement time period Tt3 is shorter than the sheets interval time period Tt2, two developing operations are continuously performed (12, 13).

The CPU 42 determines whether the developing unit of the last color is the developing unit 5d (14). If NO in step (14), the flow advances to step (17) to shift movement to that of the next developing unit, and the flow returns to step (12). However, if YES in step (14), the CPU 42 determines whether the designated number of sheets for copy is obtained (15). If YES in step (15), processing is ended. However, if NO in step (15), the developing unit 5a of the first color is moved to the axial position of the photosensitive drum 19, and the flow returns to step (12). The above operation is repeated until the designated number of sheets for copy is obtained.

If NO in step (4), i.e., when two transfer sheets 63 cannot be absorbed on the transfer drum 27, normal developing processing in a single-sheet absorption mode is performed (18). The CPU 42 determines whether the developing unit is the developing unit 5a of the last color (19). If NO in step (19), the next developing unit is moved to the the axial position of the photosensitive drum 19 (22), and the flow returns to step (19).

If YES in step (19), the CPU 42 determines whether the designated number of sheets for copy is obtained (20). If YES in step (20), processing is ended. However, if NO in step (20), the developing unit 5d of the first color is moved to the axial position of the photosensitive drum 19, and the flow returns to step (18).

In the above embodiment, two fixed points of the transfer drum 27 are detected by the position sensor 46 or the like, and the absorption timings of the transfer sheets 63 fed to the transfer drum 27 are determined, thereby absorbing the leading ends of the transfer sheets 63 to the absorption points A and B. The absorption positions of the transfer sheets 63 are not limited to these two points but can be controlled such that a plurality of transfer sheets can be absorbed at arbitrary positions of the transfer drum 27 consisting of a seamless transfer film. At the same time, the means for moving the developing units 5a to 5d may be constituted by, e.g., a stepping motor, to control the paper feed timings in synchronism with movement time periods. With this arrangement, the copying operation can be started without time losses. A maximum number of transfer sheets 63 to be wound around the peripheral surface of the transfer drum 27 can be actually wound on the transfer drum 27 to perform copying operations, thus greatly increasing the throughput.

Another embodiment of the present invention will be described with reference to FIG. 11.

Second Embodiment

Figures 11, 12:
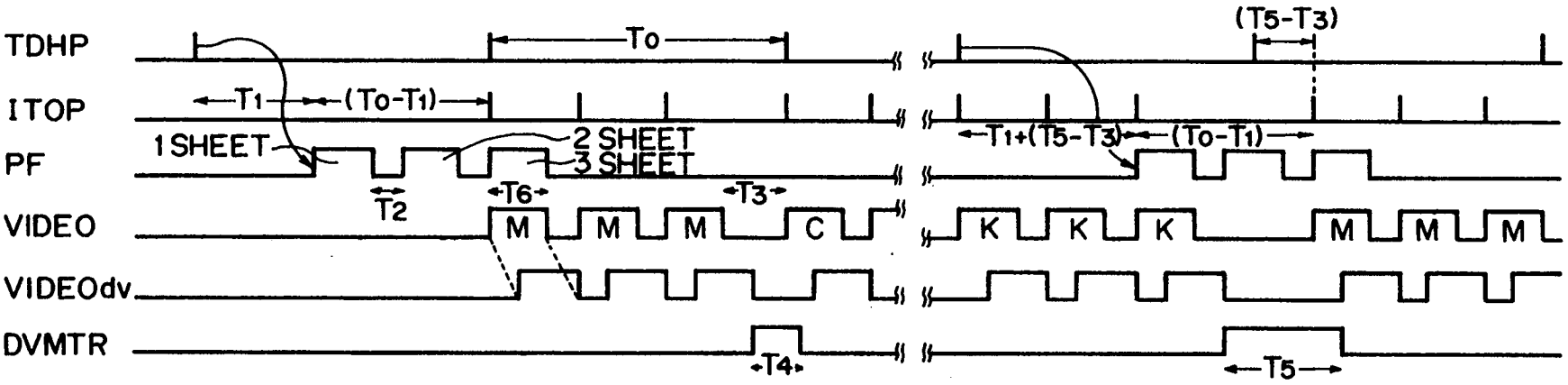
FIG. 11 is a timing chart for explaining a color copying operation according to another embodiment of the present invention.
FIG. 12 is a view showing movement time periods through all developing units.

FIG. 11 is a timing chart for explaining a color copying operation of the second embodiment.

In this embodiment, a maximum of three transfer sheets 63 can be wound around a transfer drum 27.

Referring to FIG. 11, a transfer drum rotation signal TDHP is generated in response to a sensor output from a photoencoder or the like upon one rotation of the transfer drum 27. The transfer drum rotation signal TDHP has a period T0. An image leading end signal ITOP is output for every line in a subscanning direction of laser exposure at any timing after the transfer drum rotation signal TDHP is output.

The leading edge of the image signal VIDEO of the first image is synchronous with generation of the transfer drum rotation signal TDHP. An image signal at a development position is defined as VIDEOV. After the first transfer sheet 63 is fed with a delay time T1 from the transfer drum rotation signal TDHP (prior to a time period (T0−T1) of image output), and the remaining two transfer sheets 63 are fed at predetermined sheet interval timings T2 since a maximum of three transfer sheets can be wound around the transfer drum. The maximum number of sheets to be wound on the transfer drum is given by the following condition. The condition is given as a maximum value of N when a sheets interval time period T4 between the trailing end of the Nth transfer sheet wound on the drum and the leading end of the first transfer sheet is longer than a movement time period T4 required for moving the adjacent developing unit to the development position, and a time period T6 required for one transfer cycle satisfies $T6>(T0-(T6+T2)\times N)\geqq T4$. In this embodiment, the maximum number of sheets is 3.

If the above condition is satisfied, during the time period required for movement by the distance between the last wound transfer sheet and the first wound transfer sheet, the adjacent developing unit can be moved, and the developing and transfer operations can be sequentially performed without idle rotation. When the developing unit used is to be changed from a developing unit 5*a* of the last color (black) to a developing unit 5*d* of the first color (magenta), the movement distance of the magenta developing unit 5*d* is longer than that of the black developing unit 5*a*, and the magenta developing unit 5*d* cannot be moved to the development position within the time period T3 required for movement by the distance between the trailing end of the first transfer sheet and the leading end of the last transfer sheet. For this reason, the next transfer sheet is fed with a delay time corresponding to a shortage (T5−T3) from the normal time period T1. The next transfer sheet is fed after a lapse of the time period (T1+(T5−T3)) upon generation of the transfer drum rotation signal TDHP. After a lapse of the time period (T5−T3) upon generation of the transfer drum rotation signal TDHP, the image leading end signal ITOP is generated at a predetermined timing- When a developing operation of the newly fed transfer sheet 63 is to be performed, movement of the developing units 5*a* to 5*d* is completed. This operation is repeated by a necessary number of sheets for copy, thereby completing the copying operation.

In the above embodiment, the developing units 5*a* to 5*d* are linearly moved to develop a latent image formed on the photosensitive drum 19. However, as shown in Japanese Patent Laid-Open (Kokai) No. 62-36964 , the present invention is applicable to an arrangement wherein the respective developing units are rotated and selectively located to a predetermined position.

The present invention will be described in more detail on the basis of movement of each developing unit.

FIG. 12 shows time periods required for changing the developing units. Referring to FIG. 12, DVHP represents a home position of a developer carrier. The home position is detected by a sensor (not shown) at the time of power-on operation, at the start of copying, and at the end of copying. The subsequent movement is controlled by the controller 47 for developer motor in accordance with respective development positions with respect to the developing unit home position. The home position DVHP is defined as a position where the center of the M (magenta) developing unit 5*d* and the C (cyan) developing unit 5*c* is aligned with the axis of rotation of the photosensitive drum 19. Relation $T_{MH}=T_{HM}=T_{CH}=T_{HC}$ is established in FIG. 12. Since sleeve intervals of the developing units are equal to each other to be ld, relation $T_{MC}=T_{CM}=T_{MY}=T_{YM}=T_{MK}=T_{KM}$ is established. Similarly, $T_{MY}=T_{YM}=T_{CK}=T_{KC}$ can also be established.

These values apparently satisfy the following inequality from the movement distances:

$$T_{MH}<T_{MC}<T_{MY}<T_{MK}$$

FIGS. 5 and 6 are cross-sectional views showing the states wherein the transfer sheets are absorbed on the transfer drums 27 shown in FIG. 1. More specifically, FIG. 5 shows the state wherein only one transfer sheet is absorbed on the transfer drum 27, and FIG. 6 is the state wherein the two transfer sheets are absorbed on the transfer drum 27.

Intervals and lt2 in FIGS. 5 and 6 indicate sheet intervals. The diameter of the transfer drum 27 is determined to satisfy relations $Tt1=lt1/Vt>T_{MC}$ and $Tt2=lt2/Vt>T_{MC}$ where Vt is the rotational speed of the transfer drum 27. As in the shift from movement of the magenta developing unit to that of the cyan developing unit, the movement time period required for moving the adjacent developing unit to the development position is shorter than the sheets interval time period required for sheets interval movement on the transfer drum 27. In this case, the developing units can be moved within the sheets interval time period without idle rotation.

Retransfer of toner particles from the transfer drum to the photosensitive drum can be prevented since idle rotation of the transfer drum can be eliminated.

Figure 13B:
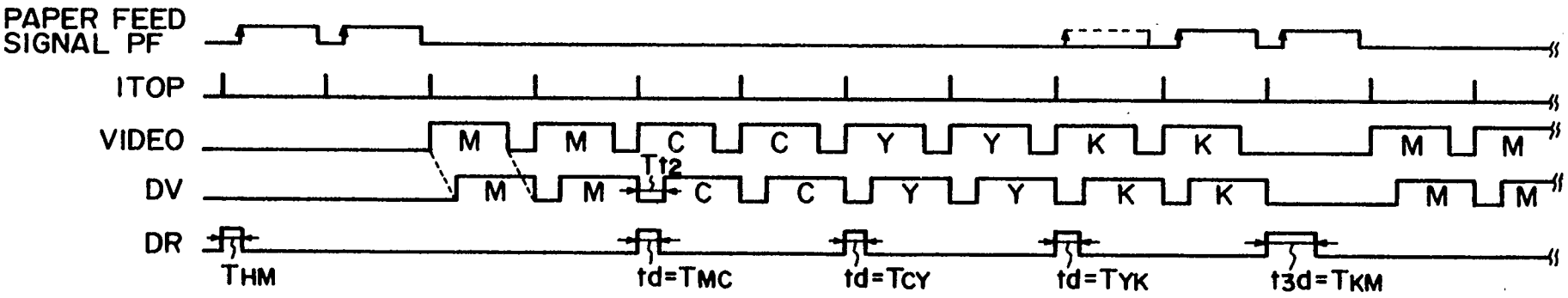
Figure 14A:
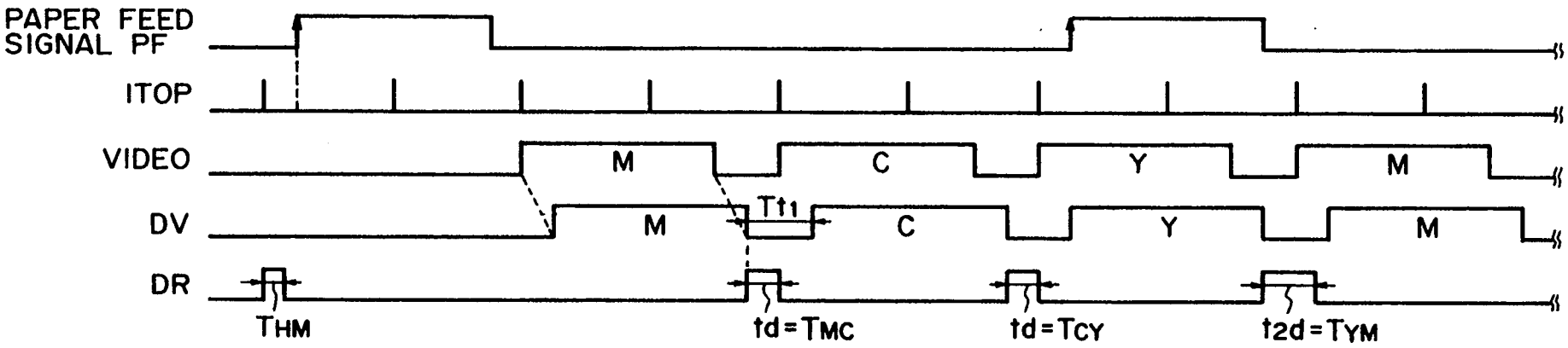
Figure 14B:
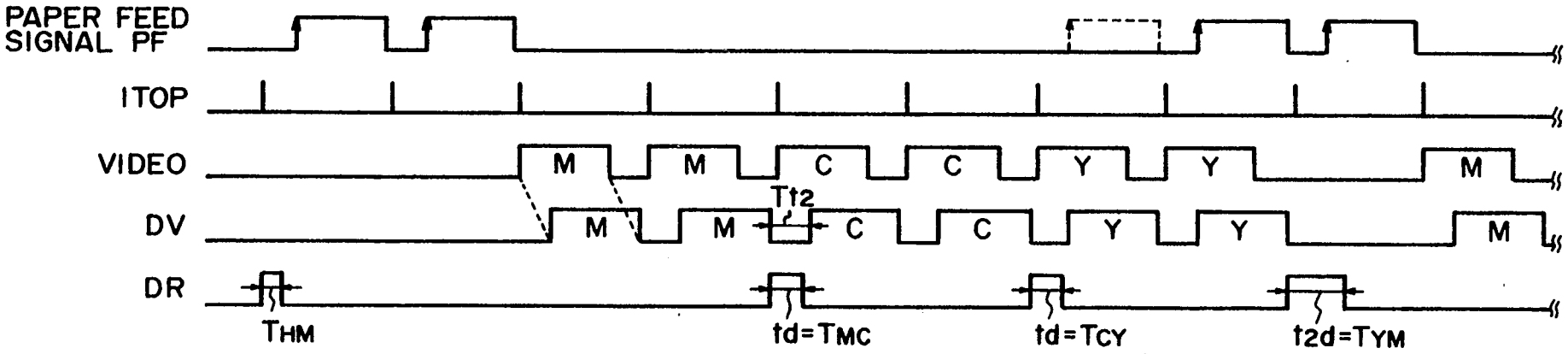
Figure 15:
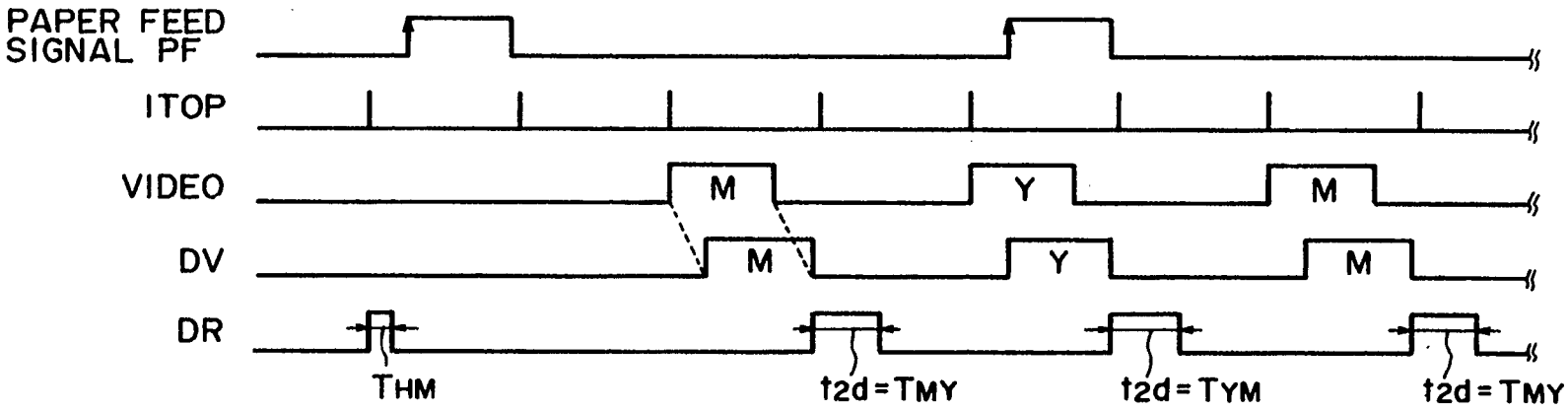
Figure 16A:
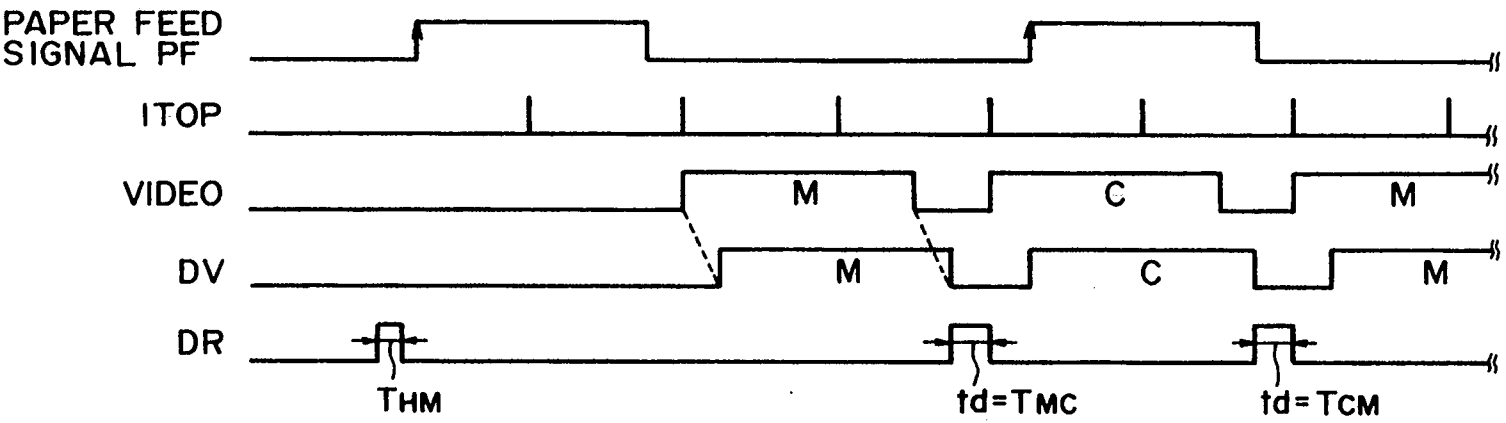
Figure 16B:
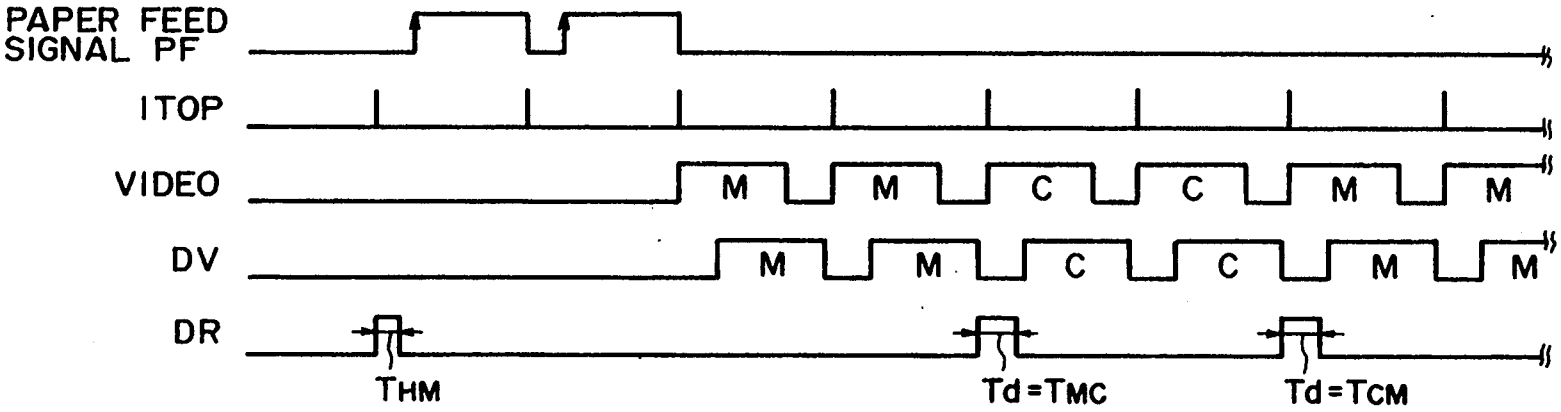
Figure 17A:
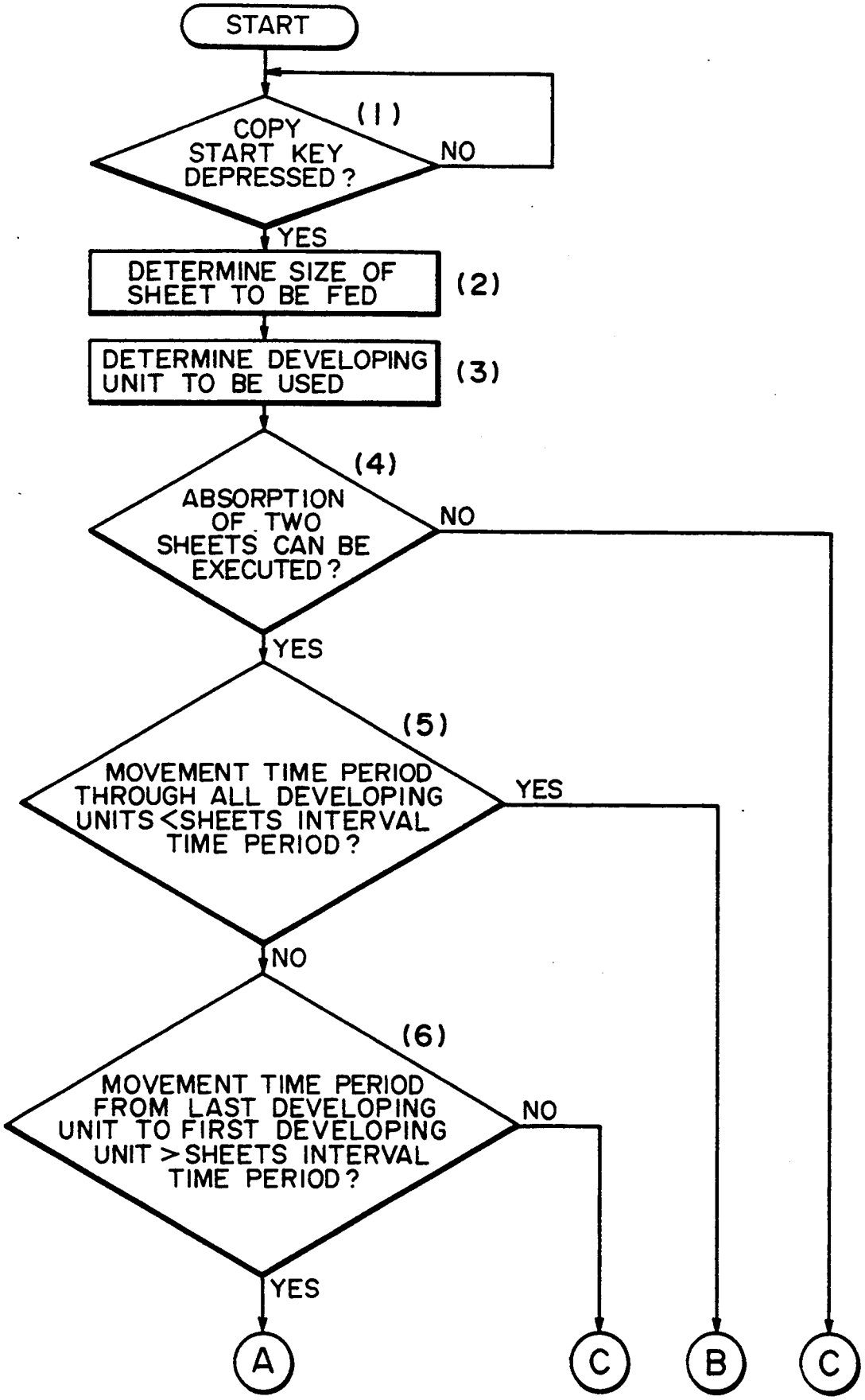
FIGS. 17A to 17D are flow charts for explaining a paper feed and developing sequence according to the present invention.
Figure 17B:
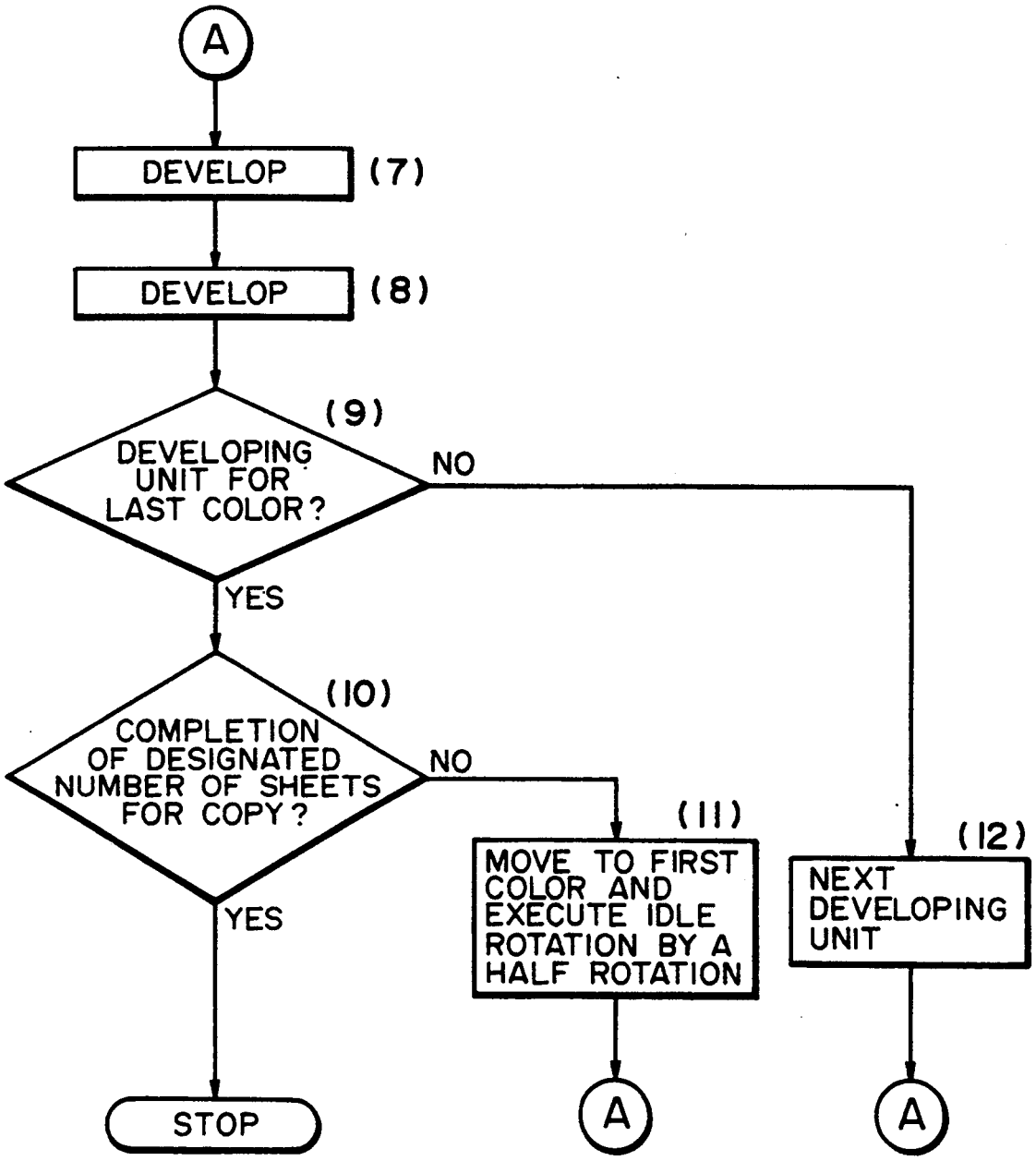
Figure 17C:
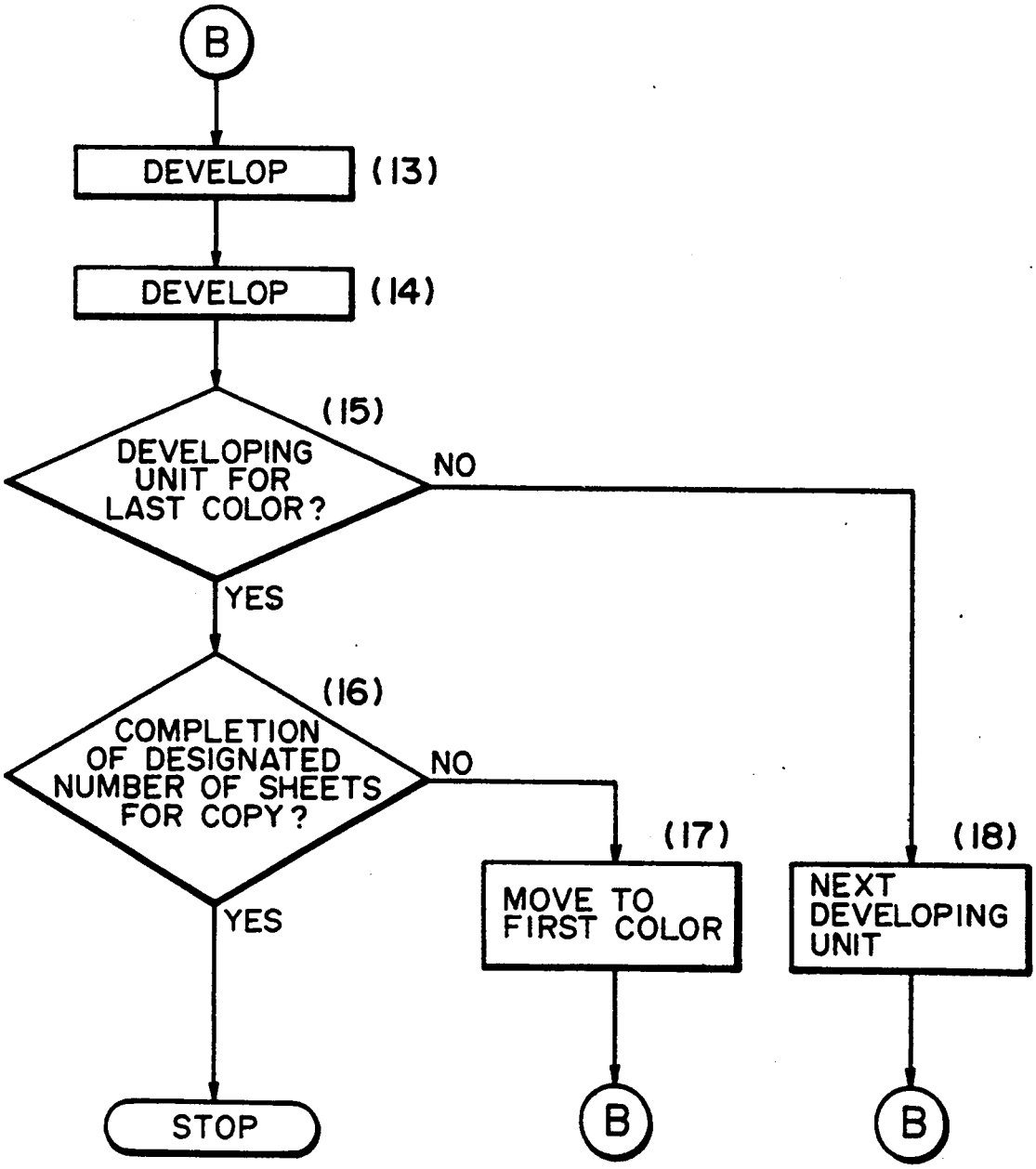
Figure 17D:
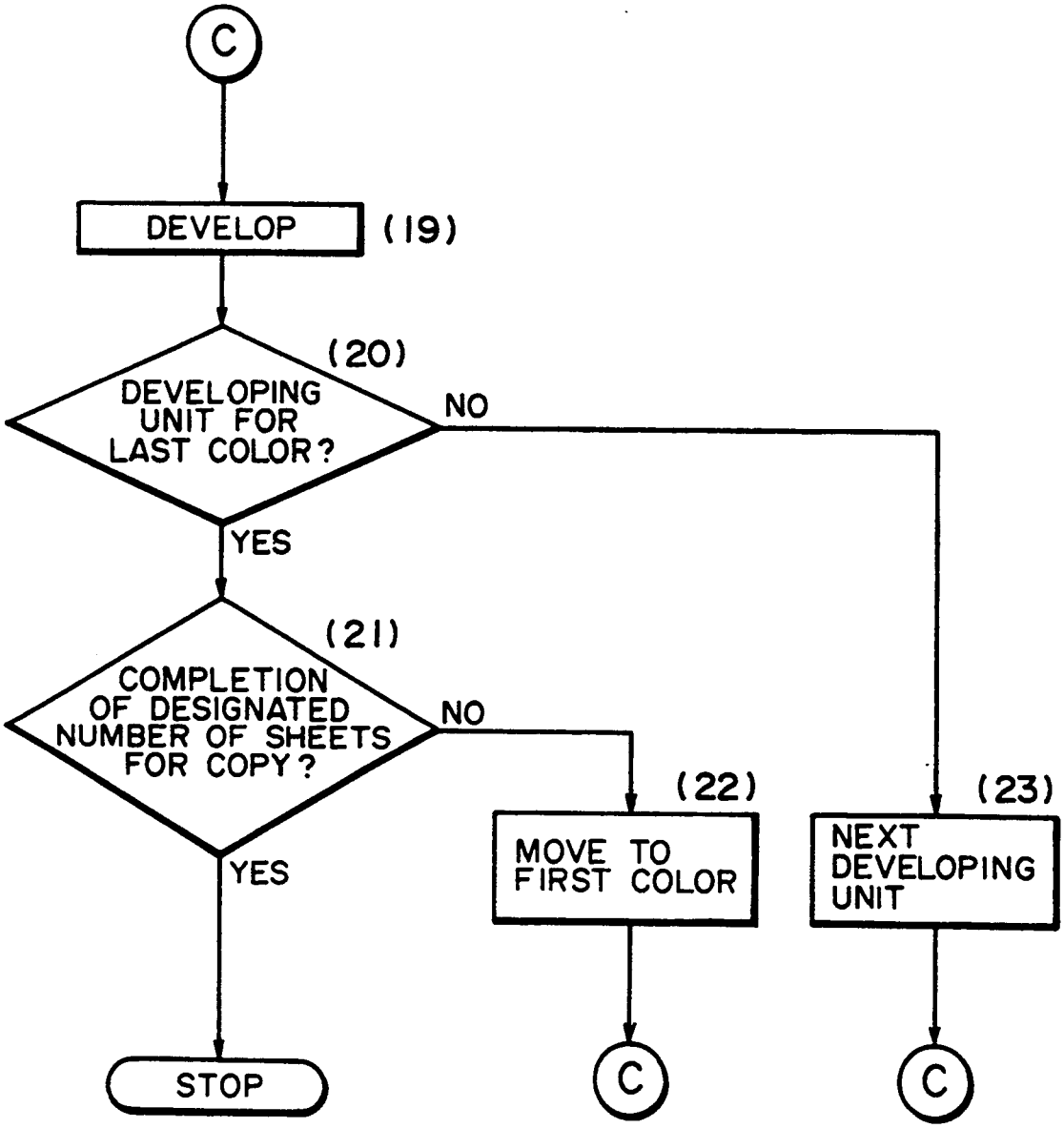
Figure 19:
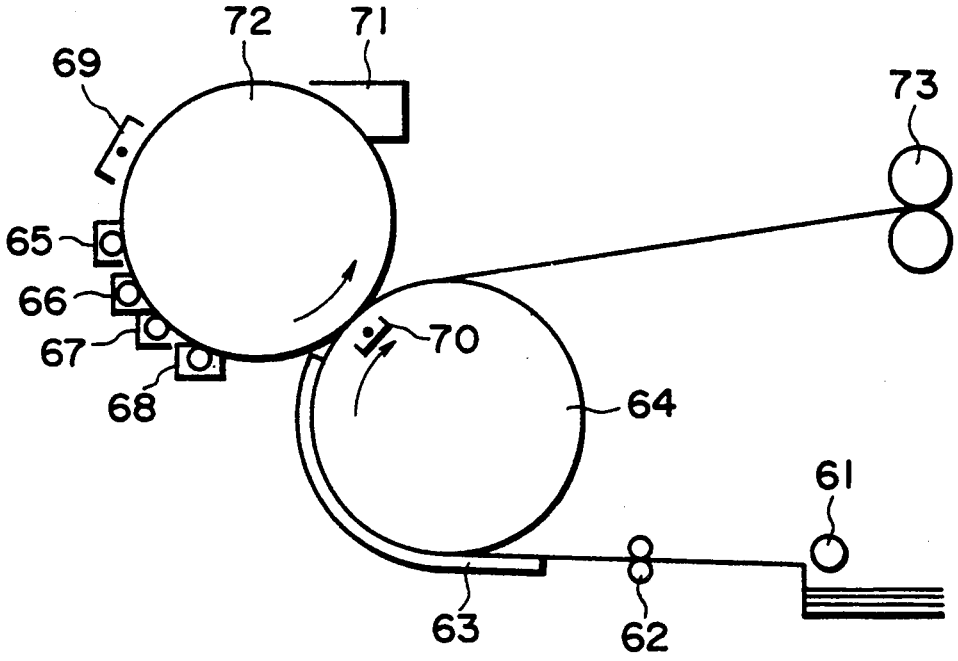
FIG. 19 PRIOR ART

FIGS. 13A and 13B, FIGS. 14A and 14B, FIG. 15, and FIGS. 16A and 16B are timing charts for explaining paper feed and developing operations of the present invention. FIGS. 13A, 14A, 15, and 16A each show a single-sheet absorption mode in which one transfer sheet is absorbed on the transfer drum 27. FIGS. 13B, 14B, and 16B each show a two-sheet absorption mode in which two transfer sheets are absorbed on the transfer drum 27.

In FIGS. 13A and 13B, FIGS. 14A and 14B, FIG. 15, and FIGS. 16A and 16B, a paper feed signal PF rises after a lapse of a predetermined period of time upon generation of an image leading end signal ITOP and falls upon completion of feeding of the transfer sheet 63.

Image signals VIDEO include a magenta image signal VIDEO M, a cyan image signal VIDEO C, a yellow image signal VIDEO Y, and a black image signal VIDEO K. Each image signal is output within a time period corresponding to a sheet size from the leading edge of the signal ITOP. Signals DV represent that development is being performed. The signals DV include magenta, cyan, yellow, and black developing signals as in the image signals VIDEO. The developing signal DV is enabled during development of a latent image formed by exposing the uniformly charged photosensitive drum 19 with a laser beam modulated with the corresponding image signal VIDEO- A developing unit drive signal DR causes one transfer sheet 63 to absorb on the transfer drum 27 in the one-sheet absorption mode- In a four-color mode (FIG. 13A) using four developing units, a movement time period t3d ($=T_{KM}$) required for shifting movement of the developing unit 5*a* of the fourth color (black) having the longest movement distance to movement of the developing unit 5*d* of the first color (magenta) having the shortest movement distance is shorter than the sheets interval time period ($T_{MC}$, $T_{CY}$, $T_{YK}$, and $T_{KM}$) of each developing unit is shorter than the time period Tt1, and the color copying sequence of the transfer sheet 63 can be continuously performed without idle rotation. FIG. 13B is a timing chart of a four-color mode using the magenta, cyan, yellow, and black developing units when two transfer sheets 63 (i.e., a two-sheet absorption mode) are absorbed on the transfer drum 27.

In this case, a movement time period $td=T_{MC}=T_{CY}=T_{YK}$ for shifting movement to the movement of the adjacent developing unit is shorter than the sheets interval time period Tt2, the copying sequence can be performed without posing any problem. However, since the maximum developing unit movement time period $t3d=T_{KM}$ is longer than the sheets interval movement time period Tt2 in the four-color mode, feeding of the next sheet is delayed by one ITOP period (i.e., a half rotation of the transfer drum), and the movement is shifted from the movement of the black developing unit to that of the magenta developing unit during this period. Therefore, the color copying sequence of two transfer sheets to be absorbed next can be executed. This operation has been described with reference to FIGS. 9A to 9D.

A three-color copying mode for performing a color copying sequence using three developing units, i.e., the magenta developing unit 5*d*, the cyan developing unit 5*c*, and the yellow developing unit 5*b* will be described below with reference to FIGS. 14A and 14B.

FIG. 14A is a timing chart showing a single-sheet absorption mode in the three-color copying mode. In this case, a maximum developing unit movement time period t2d ($=T_{YM}$) in the three-color copying mode is shorter than the maximum developing unit movement time period t3d ($=T_{KM}$) in the four-color copying mode, so that each developing unit can be moved within a minimum sheets interval time period Tt1 in the single-sheet absorption mode- Therefore, a color copying sequence can be executed without an idle rotation sequence.

FIG. 14B is a timing chart in a two-sheet absorption mode in a three-color copying mode.

The maximum developing unit movement time period t2d ($=T_{YM}$) in the three-color copying mode is longer than the sheets interval time period Tt2 for the two-sheet absorption mode in this embodiment. In the same manner as in the four-color copying mode, the feed timing of the first one of the next two transfer sheets is delayed by a half rotation of the transfer drum 27. By utilizing this period of time, the movement is shifted from that of the yellow developing unit to that of the magenta developing unit.

FIG. 15A is a timing chart of a two-color copying mode for outputting a red image by utilizing two developing units, i.e., the magenta developing unit 5*d* and the yellow developing unit 5*b*. In this case, the time period $T_{MY}$ required for moving the yellow developing unit upon completion of development with magenta is longer than the sheets interval time period for the two-sheet absorption mode. Therefore, in the two-color copying mode using magenta and yellow, two-sheet absorption is not performed, and a color copying sequence is performed in a single-sheet absorption mode in which one transfer sheet is absorbed on the transfer drum 27. To the contrary, in a two-color mode using magenta and yellow in which two sheets can be absorbed on the transfer drum, idle rotation by a half rotation of the transfer drum may be performed to increase a movement time period for shifting movement from that of the magenta developing unit to that of the yellow developing unit. In this case, however, since the shift in movement is not from the last color to the first color, the two absorbed transfer sheets are not separated. Idle rotation by a half rotation of the transfer drum is performed while the two transfer sheets are kept absorbed on the transfer drum. The first absorbed transfer sheet passes the transfer position without retransfer of the toner to the photosensitive drum. In this case, the second transfer sheet is separated after the development and transfer of the yellow toner due to the idle rotation by a half rotation. The development of the yellow toner and its transfer to the first absorbed sheet are performed.

In order to prevent retransfer of toners to the photosensitive drum, for example, high-voltage output control of the transfer charger for the first transfer sheet may be differentiated from that for the second transfer sheet. Alternatively, a means for releasing idle rotation of the transfer drum 27 relative to the photosensitive drum 19 may be used. In either case, control is complicated and cost is high.

The above problems can be solved by the present invention wherein two transfer sheets are not absorbed even if the size of the transfer sheet allows a two-sheet absorption mode, when the developing unit change time period except for the shift from the developing unit of the last color to the developing unit of the first color is longer than the sheets interval time periods.

FIG. 16A is a timing chart of a one-sheet absorption mode in a two-color copying mode using the magenta and cyan developing units. FIG. 16B is a timing chart of a two-sheet absorption mode using the same color. In this case, the developing units to be used are adjacent to each other, and the developing unit movement time period $T_{MC}$ is shorter than the sheets interval time period Tt2 for absorbing the two transfer sheets. Therefore, the two transfer sheets can be absorbed on the transfer drum. In addition, the movement time period $T_{CM}$ for shifting movement of the developing unit 5*c* of the last color (cyan) to that of the developing unit 5*d* of the first color (magenta) is also shorter than the sheets interval time period Tt2. In this case, a color copying sequence without idle rotation by a half rotation of the transfer drum can be performed.

Paper feed and developing operations of the present invention will be described with reference to FIGS. 17A to 17D.

FIGS. 17A to 17D are flow charts showing paper feed and developing processing according to the present invention. Reference numerals (1) to (23) in FIG. 17 denote steps.

A color mode, the number of sheets for copy, a sheet size, and the like are designated at an operation section (not shown). When a copy start key in the operation section is depressed (1), a CPU 42 determines a sheet size from a detection signal from a paper feed unit 2 (2) and determines developing units to be used (3).

The CPU 42 determines whether two transfer sheets 63 are placed on a transfer drum 27 in accordance with the determined sheet size and the determined developing units to be used, i.e., determines a size whether the two transfer sheets 63 can be absorbed on the transfer drum 27 (4). If NO in step (4), the flow advances to step (19) and the subsequent steps. A color copying sequence in the single-sheet absorption mode is executed. However, if YES in step (4), a time period required for movement of the developing units to be used is calculated from FIG. 12. The CPU 42 determines whether each of all the developing unit movement time periods is shorter than the sheets interval time period (5). For example, in a blue color mode, each of all the developing unit movement time periods is shorter than the sheets interval time period although the magenta and cyan developing units are used. In this case, the flow advances to step (13) and the subsequent steps. In addition, since only one of the developing units is used in a magenta, cyan, yellow, or black color mode, the developing unit movement time period is assumed to be zero, and the flow advances to step (13) and the subsequent steps.

If at least one of the time periods required for moving the developing units in the color copying sequence is longer than the sheets interval time period Tt2 required for the two-sheet absorption mode, the flow advances to step (6). The CPU 42 then checks whether this longer time period is longer than a time period required for shifting movement of the development unit of the last color to that of the developing unit of the first color (6). In this embodiment, since the development is performed in an order of magenta, cyan, yellow, and black regardless of copying modes, the developing unit of the last color is the black developing unit 5*a* and the developing unit of the first color is the magenta developing unit 5*d*. Similarly, in a red color mode, the developing unit of the last color is the yellow developing unit 5*b* and the developing unit of the first color is the magenta developing unit 5*d*.

In the decision block of step (6), when only the movement time period for shifting movement of the developing unit of the last color to that of the developing unit of the first color is longer than the sheets interval time period, an operation for feeding the next sheets is delayed by a half rotation of the transfer drum. In this case, even if the developing unit is moved, the two transfer sheets are subjected to transfer operation of the last developing color and are separated at the separation position. The transfer sheets do not pass through the transfer position again while they carry the toner images thereon. For this reason, the transfer conditions can be made constant. In addition, a color copying sequence can be performed with only idle rotation by a half rotation of the transfer drum. Therefore, the throughput is not undesirably decreased.

The color modes subjected to the above processing are the three- and four-color copying modes, and the two transfer sheets are developed continuously by using the selected developing units (7, 8).

The CPU 42 determines whether the developing unit used is the developing unit of the last color, e.g., the black developing unit 5*a* in the four-color copying mode (9). If NO in step (9), the CPU 42 sends a command to a controller 47 for developer motor to move the next developing unit to the axial position of the photosensitive drum 19 (12). The flow then returns to step (7), and the next developing operation is performed.

If YES in step (9), the CPU 42 determines whether a designated number of sheets for copy is obtained (10). If YES in step (10), processing is ended- However, if NO in step (10), the paper feed timing is delayed by a half rotation of the transfer drum- The CPU 42 sends a command to the controller 47 of developer motor to shift the movement from movement of the developing unit of the last color to that of the first color by utilizing this delay time (11).

If NO in step (6), that is, when two transfer sheets 63 can be absorbed on the transfer drum 27 and the maximum movement time period of the developing units in a color mode as in the blue color mode is shorter than the sheets interval time period Tt2, the two developing operations are continuously performed (13, 14).

The CPU 42 determines whether the developing unit of the last color is the developing unit 5*d* (15). If NO in step (15), the flow advances to step (16), and the next developing unit is moved. The flow then returns to step (13). If YES in step (15), the CPU 42 determines whether the designated number of sheets for copy is obtained (16). If YES in step (16), processing is ended. However, if NO in step (16), the developing unit 5*a* of the first color is moved to the axial position of the photosensitive drum 19 (17), and the flow returns to step (13). The above operation is repeated until the designated number of sheets for copy is obtained.

When the developing unit movement time period except for shift in movement from the developing unit of the last color to the developing unit of the first color is longer than the sheets interval time period, and even if the two transfer sheets are absorbed in step (6), the transfer sheets pass through or do not pass through the transfer position while the transfer sheets carry the toner images thereon. In this case, a transfer condition of the first transfer sheet becomes different from that of the second transfer sheet, thus complicating the control. Therefore, in this case, the two transfer sheets are not absorbed on the transfer sheets. The flow jumps to step (19) for executing a single-sheet absorption mode as in the red color mode.

Developing processing is performed in the single-sheet absorption mode is performed (19), and the CPU 42 determines whether the developing unit is the developing unit 5*a* of the last color (20). If NO in step (20), the next developing unit is moved to the axial position of the photosensitive drum 19 (23), and the flow returns to step (19).

If YES in step (20), the CPU 42 determines whether the designated number of sheets for copy is obtained (21). If YES in step (21), processing is ended. However, if NO in step (21), the developing unit 5*d* of the first color is moved to the axial position of the photosensitive drum 19 (22), and the flow returns to step (19).

In the embodiment described above, it is presumed that the transfer drum 27 and the photosensitive drum 19 are rotated at constant speeds. However, a means for driving the transfer drum 27 and the photosensitive drum 19 is constituted by, e.g., a stepping motor, and these drums may be slowed down or stopped at an arbitrary position, and each developing unit may be moved during the sheets interval time period of the two transfer sheets absorbed on the transfer drum. In this case, the sheets interval time period can be controlled by the motor in correspondence with the movement time period of each developing unit, thereby obtaining a maximum throughput.

Even if a copying operation is performed using the cyan developing unit 5c and the black developing unit 5a, although this operation is not included in the color modes shown in FIG. 18, a two-sheet absorption mode is not employed, but a single-sheet absorption mode is used to obtain the same effect as described above.

As has been described above, the sheet feed timings are controlled in accordance with the change time period of the developing unit currently used, and the change time period required for shifting movement of the developing unit currently used to the next developing unit, and the transfer sheet size. When multiple transfer is to be performed, retransfer of the toners on the transfer medium wound around the transfer drum to the photosensitive drum can be prevented without complicating the arrangement of the apparatus and control, and obtaining a maximum throughput.

What is claimed is:

1. A recording apparatus comprising:

a recording body on which a latent image is to be formed;

a movable developing assembly which can be brought into contact with or separated from said recording body, said movable developing assembly comprising a plurality of developing units for developing the latent image;

a transfer medium holding body having means for winding a plurality of transfer media on said transfer medium holding body;

means for separating the transfer media wound around said transfer medium holding body;

designation means for designating a plurality of said developing units to be used, and at least one developing unit to be disabled, in accordance with a color mode of image recording; and means for adjusting a transfer medium feed timing in accordance with a change time period of said plurality of developing units designated by said designating means and a transfer medium size.

2. A recording apparatus comprising:

a recording body on which a latent image is to be formed;

a movable developing assembly which can be brought into contact with or separated from said recording body, said movable developing assembly consisting of a plurality of developing units for developing the latent image;

a transfer medium holding body having means for winding a plurality of transfer media on said transfer medium holding body;

means for separating the transfer media wound around said transfer medium holding body;

means for adjusting a transfer medium feed timing in accordance with a change time period of said plurality of developing units to be used and a transfer medium size; and means for reducing the number of transfer media wound on said transfer medium holding body when a change in developing unit used is not completed within a time period during which said transfer medium holding body is moved by a distance between leading and trailing ends of adjacent transfer media and when the plurality of transfer media are wound on said transfer medium holding body.

3. An apparatus according to claim 2, wherein a decrease in the number of transfer media wound on said transfer medium holding body is inhibited when the change in developing unit within the time period is not allowed due to only a change from a developing unit of a last color to a developing unit of a first color.

4. A color recording apparatus comprising:

a recording body on which a latent image is to be formed;

a plurality of developing units comprising plural developers each having a respective different color and for developing a latent image, said plurality of developing units moving integrally, and each of said developing units being arranged to be brought into contact with or separated from said recording body;

means for conveying at least one transfer sheet;

a sheet maintaining body for maintaining the transfer sheet conveyed by said conveying means, said sheet maintaining body being arranged to maintain a plurality of the transfer sheets; and means for controlling a number of the transfer sheets to be maintained by said sheet maintaining body in accordance with an exchange time of said plurality of developing units for forming a predetermined color image.

5. An apparatus according to claim 4, wherein said sheet maintaining body is formed in a configuration of a drum, and wherein the transfer sheets are absorbed by a surface of said drum.

6. An apparatus according to claim 4, wherein said plurality of developing units move integrally and linearly together when said developing units are to be exchanged.

7. An apparatus according to claim 4, wherein said plurality of developing units move integrally and rotationally together when said developing units are to be exchanged.

8. An apparatus according to claim 4, wherein when the transfer sheet is larger than a predetermined size, said sheet maintaining body maintains a piece of the transfer sheet in accordance with said means for controlling.

9. A color printing apparatus comprising:

means for irradiating an original;

means for forming a latent image on a recording medium in accordance with an original irradiated by said means for irradiating;

a plurality of developing units each having a respective different color of a developer for developing the latent image formed on said recording medium, said plurality of developing units moving in a line integrally together, and each of said developing units being arranged to be brought into contact with or separated from said recording medium;

means for transferring a developed image on said recording medium to a transfer sheet;

means for setting a copying number;

designation means for designating a plurality of said developing units to be used, and at least one developing unit to be disabled, in accordance with a color mode of image recording; and means for controlling an operation timing of a next copying cycle in accordance with an exchange time of said plurality of developing units designated by said designation means when said means for setting sets plural times of copying.

10. An apparatus according to claim 9, wherein said plurality of developing units are arranged in a line in a horizontal direction, and wherein aid developing units move in the horizontal direction when aid developing units are to be exchanged.

11. An apparatus according to claim 9, wherein said means for controlling controls the operation timing of the next copying cycle in accordance with a time for exchanging one of said developing units used as a last one of said developing units of a prior copying cycle with one of said developing units to be used at a beginning of the next copying cycle.

12. A color recording apparatus comprising:

a recording body on which a latent image is to be formed;

a plurality of developing units each comprising a respective different color of a developer for developing the latent image, said plurality of developing units moving integrally and linearly together, and each of said developing units being arranged to be brought into contact or separated from the recording body;

means for conveying a transfer sheet;

a sheet maintaining body for maintaining the transfer sheet conveyed by said means for conveying, and for transferring the latent image onto the transfer sheet;

designation means for designating a plurality of said developing units to be used, and at least one developing unit to be disabled, in accordance with a color mode of image recording; and means for controlling a timing at which said sheet maintaining body maintains the sheet in accordance with an exchange time of said plurality of developing units designated by said designation means.

13. An apparatus according to claim 12, wherein said means for controlling controls a sheet maintaining timing of a next image formation cycle in accordance with a time for exchanging one of said developing units used in a prior image forming cycle with one of said developing units to be used in the next image forming cycle.

14. An apparatus according to claim 12, wherein said plurality of developing units are arranged in a line in a horizontal direction, and wherein said developing units move in a horizontal direction when said developing units are to be exchanged.

* * * * *

UNITED STATES PATENT AND TRADEMARK OFFICE

CERTIFICATE OF CORRECTION

PATENT NO. : 5,335,056

DATED : August 2, 1994

INVENTOR(S) : Masanori Muramatsu, et al.

It is certified that error appears in the above-identified patent and that said Letters Patent is hereby corrected as shown below:

COLUMN 1

Line 15, "illustrating" should read --illustrating a--.

COLUMN 2

Line 64, "paperfeed" should read --paper feed--.

COLUMN 3

Line 50, "FIG. 3 s" should read --FIG. 3 is--.

COLUMN 5

Line 56, "the.pa-" should read --the pa- --;
Line 58, "period of" should be deleted; and
Line 59, "a" should read --a period of--.

COLUMN 6

Line 16, "arequired" should read --a required--.

COLUMN 7

Line 33, "[ceding" should read --feeding--; and
Line 45, "VIDEOdrY" should read --VIDEOdvY--.

UNITED STATES PATENT AND TRADEMARK OFFICE

CERTIFICATE OF CORRECTION

PATENT NO. : 5,335,056

DATED : August 2, 1994

INVENTOR(S) : Masanori Muramatsu, et al.

It is certified that error appears in the above-identified patent and that said Letters Patent is hereby corrected as shown below:

COLUMN 9

Line 18, "restatted" should read --restarted--;
Line 37, "i.e-," should read --i.e.,--;
Line 39, "(i.e-," should read --(i.e.,--; and
Line 58, "e.g-," should read --e.g.,--.

COLUMN 10

Line 7, "(9)-" should read --(9).--; and
Line 10, "aid" should read --said--.

COLUMN 11

Line 59, "timing-" should read --timing.--.

COLUMN 12

Line 36, "Intervals" should read --Intervals lt1--.

COLUMN 13

Line 10, "VIDEO-" should read --VIDEO.--;
Line 13, "mode-" should read --mode.--; and
Line 57, "mode-" should read --mode.--.

UNITED STATES PATENT AND TRADEMARK OFFICE

CERTIFICATE OF CORRECTION

PATENT NO. : 5,335,056

DATED : August 2, 1994

INVENTOR(S) : Masanori Muramatsu, et al.

It is certified that error appears in the above-identified patent and that said Letters Patent is hereby corrected as shown below:

COLUMN 16

Line 14, "ended-" should read --ended.--; and
Line 16, "drum-" should read --drum.--.

Signed and Sealed this

Sixth Day of December, 1994

*Attest:*

*Attesting Officer*

Bruce Lehman

BRUCE LEHMAN

*Commissioner of Patents and Trademarks*